US010472846B2

(12) United States Patent
North et al.

(10) Patent No.: US 10,472,846 B2
(45) **Date of Patent: *Nov. 12, 2019**

(54) WEIGHT SYSTEMS AND METHODS STABILIZING OBJECTS

(71) Applicant: Premier Tents, Inc., Bellingham, WA (US)

(72) Inventors: Robert Wallace North, Bellingham, WA (US); Paula Kay North, Bellingham, WA (US)

(73) Assignee: Premier Tents, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/216,810

(22) Filed: Dec. 11, 2018

(65) Prior Publication Data

US 2019/0119939 A1 Apr. 25, 2019

Related U.S. Application Data

(63) Continuation of application No. 15/461,160, filed on Mar. 16, 2017, now Pat. No. 10,151,121, which is a continuation of application No. 15/273,494, filed on Sep. 22, 2016, now Pat. No. 10,087,647.

(60) Provisional application No. 62/390,096, filed on Mar. 21, 2016.

(51) Int. Cl.

| | |
|---|---|
| ***E04H 12/22*** | (2006.01) |
| ***A45B 23/00*** | (2006.01) |
| *A45B 25/14* | (2006.01) |

(52) U.S. Cl.

CPC ..... *E04H 12/2246* (2013.01); *A45B 23/00* (2013.01); *A45B 2023/0012* (2013.01); *A45B 2023/0031* (2013.01); *A45B 2023/0037* (2013.01); *A45B 2025/146* (2013.01)

(58) Field of Classification Search

CPC ..... A45B 2023/0012; A45B 25/22; E04H 12/2246; Y10S 248/91

See application file for complete search history.

(56) References Cited

U.S. PATENT DOCUMENTS

| | | | |
|---|---|---|---|
| 3,216,681 | A | 11/1965 | Tagliavia |
| 4,296,693 | A | 10/1981 | Archer |
| 4,486,016 | A | 12/1984 | Rubin |
| 4,832,163 | A | 5/1989 | Levesque |
| 5,169,111 | A | 12/1992 | Dunaj |
| 5,452,877 | A | 9/1995 | Riffle et al. |

(Continued)

*Primary Examiner* — Bradley Duckworth

(74) *Attorney, Agent, or Firm* — Michael R. Schacht; Schacht Law Office, Inc.

(57) ABSTRACT

A weight system for supporting a free-standing object comprising a container defining an interior chamber, the container comprising at least one side wall, a lower wall, and an upper wall, where the upper wall is configured to define a fill opening and a closure system comprising first and second closure portions. The first closure portion is arranged to define a first side of the fill opening. The second closure portion is arranged to define a second side of the fill opening. The closure system is arranged to allow the container to be configured in a closed configuration in which the first closure portion engages the second closure portion substantially to prevent access to the interior chamber through the fill opening and an open configuration in which the first closure portion is disengaged from the second closure portion to allow access to the interior chamber through the fill opening.

12 Claims, 11 Drawing Sheets

(56) References Cited

U.S. PATENT DOCUMENTS

| | | | |
|---|---|---|---|
| 6,554,012 | B2 | 4/2003 | Patarra |
| 6,889,953 | B2 | 5/2005 | Harbaugh |
| 6,986,496 | B2 | 1/2006 | Woude et al. |
| 8,047,217 | B1 | 11/2011 | Schermerhorn, Jr. |
| 8,556,141 | B1 | 10/2013 | Ferraiolo |
| 8,783,274 | B1 | 7/2014 | Supino |
| 8,789,549 | B1 | 7/2014 | Barnes |
| 8,931,749 | B2 | 1/2015 | Vetesnik |
| 9,540,840 | B2 | 1/2017 | Ma et al. |
| 10,087,647 | B2 | 10/2018 | North et al. |
| 10,151,121 | B2 | 12/2018 | North et al. |
| 2004/0069922 | A1 | 4/2004 | Wu |
| 2012/0011773 | A1 | 1/2012 | Cross et al. |
| 2013/0092283 | A1 | 4/2013 | Votel et al. |
| 2015/0090307 | A1 | 4/2015 | Supino et al. |
| 2015/0159394 | A1 | 6/2015 | Oliveira |
| 2015/0320161 | A1 | 11/2015 | Perry |
| 2015/0330613 | A1 | 11/2015 | Louden et al. |
| 2017/0101799 | A1 | 4/2017 | Koerner |
| 2017/0130481 | A1 | 5/2017 | Pozybill |

WEIGHT SYSTEMS AND METHODS STABILIZING OBJECTS

RELATED APPLICATIONS

This application, U.S. patent application Ser. No. 16/216,810 filed Dec. 11, 2018, is a continuation of U.S. patent application Ser. No. 15/461,160 filed Mar. 16, 2017, now U.S. Pat. No. 10,151,121 which issued on Dec. 11, 2018.

U.S. patent application Ser. No. 15/461,160 is a continuation of U.S. patent application Ser. No. 15/273,494 filed Sep. 22, 2016, now U.S. Pat. No. 10,087,647, which issued on Oct. 2, 2018.

U.S. patent application Ser. No. 15/273,494 claims benefit of U.S. Provisional Application Ser. No. 62/390,096, filed on Mar. 21, 2016.

The contents of all applications listed above are incorporated herein by reference.

TECHNICAL FIELD

The present invention relates to free-standing objects and, more specifically, to weight systems and methods for counteracting tipping forces on portable, free-standing objects.

BACKGROUND

The present invention is of particular significance when applied to umbrella systems, and that application of the present invention will be described herein in detail. However, the principles of the present invention may be applied to other portable, free-standing objects such as patio heaters, patio lighting, traffic or construction cones, and the like. The scope of the present invention should thus be determined based on the claims appended hereto and not the following detailed descriptions of examples of the present invention as applied to free-standing umbrellas.

Umbrellas have long been used to provide protection from sun or rain. At its most basic, an umbrella typically comprises a pole, canopy rods supported by the pole, and a canopy supported by the canopy rods. The canopy rods are typically pivotably supported by the pole such that the umbrella may be reconfigured from a storage configuration in which the canopy rods are parallel to the pole and a use configuration in which the canopy rods radially extend from the pole. A form factor of the canopy in the storage configuration is much smaller than in the use configuration. Certain umbrellas further comprise a collapsible pole that allows an effective length of the umbrella to be altered between the storage configuration and the use configuration.

While many umbrellas are designed to be carried when in the use configuration, one class of umbrellas, referred to herein as free-standing umbrellas, is designed to be supported by the ground. Free-standing umbrellas are commonly used to provide protection from rain or sun on outdoor patios and seating areas for commercial bistros and the like.

The pole of a free-standing umbrella is designed to engage the ground directly or to be supported by a base that in turn engages the ground. In either scenario, the umbrella is supported by the ground rather than carried. The manner in which the pole and/or base engage the ground should also counteract tipping forces applied to the umbrella during normal use.

To support a free-standing umbrella in an upright position, the pole may be driven, augered, or otherwise inserted into the ground at a desired location. More commonly, however, a weighted base is provided that is supported on top of the ground. The umbrella pole is inserted into a base stem, and the weight of the base is intended to act on the pole through the stem to prevent tipping of the umbrella during normal use.

The base is often made out of a heavy material such as stone. To minimize shipping costs, the base may take the form of a hollow container that may be shipped empty and filled with a material such as sand or water at the time of use. However, the weight of a conventional base is insufficient to prevent tipping of the umbrella in many situations, such as during heavy winds.

To supplement the weight of the base of a conventional free-standing umbrella, additional weighted material may be placed on top of the base. For example, flexible fabric containers that may be manufactured and shipped inexpensively may be filled with sand at the point of installation of the umbrella and placed on top of the umbrella base.

The need exists for improved fabric containers for providing supplemental weight to a conventional umbrella base.

SUMMARY

The present invention may be embodied as a weight system for supporting a free-standing object comprising a container and a closure system. The container defines an interior chamber and comprises at least one side wall, a lower wall, and an upper wall, where the upper wall is configured to define a fill opening. The closure system comprises first and second closure portions, where the first closure portion is arranged to define a first side of the fill opening and the second closure portion is arranged to define a second side of the fill opening. The closure system is arranged to allow the container to be configured in a closed configuration in which the first closure portion engages the second closure portion substantially to prevent access to the interior chamber through the fill opening and an open configuration in which the first closure portion is disengaged from the second closure portion to allow access to the interior chamber through the fill opening.

The present invention may also be embodied as a weight system for supporting a free-standing object comprising first and second containers and first and second closure systems. The first container defines a first interior chamber and comprises at least one first side wall, a first lower wall, and a first upper wall, where the first upper wall is configured to define a first fill opening. The first closure system comprises first and second first closure portions, where the first first closure portion is arranged to define one side of the first fill opening and the second first closure portion is arranged to define another side of the first fill opening. The second container defines a second interior chamber and comprises at least one second side wall, a second lower wall, and a second upper wall, where the second upper wall is configured to define a second fill opening. The second closure system comprises first and second second closure portions, where the first second closure portion is arranged to define one side of the second fill opening and the second second closure portion is arranged to define another side of the second fill opening. The first first closure portion engages the second first closure portion to selectively close the first fill opening. The second first closure portion engages the second second closure portion to selectively close the second fill opening. The first and second containers are detachably attached to each other to apply a force to at least a portion of the free-standing object.

The present invention may also be embodied as a method of supporting a free-standing object comprising the following steps. First and second upper panels, at least one side panel, and a lower panel are provided. A container is defining an interior chamber is formed by forming at least one upper seam to join the first and second upper panels to the at least one side panel such that the first and second upper panels define an upper wall, the at least one side panel defines at least one side wall, and the first and second upper panels define a fill opening in the upper wall and forming at least one lower seam to join the lower panel to the at least one side panel to form a lower wall. A closure system is arranged to allow the container to be configured in a closed configuration in which access to the interior chamber through the fill opening is substantially prevented and in an open configuration in which access to the interior chamber through the fill opening is allowed.

DETAILED DESCRIPTION

The present invention may be embodied in several different forms, and several examples of different embodiments of the present invention will be separately described herein.

I. First Embodiment

Figure 1:
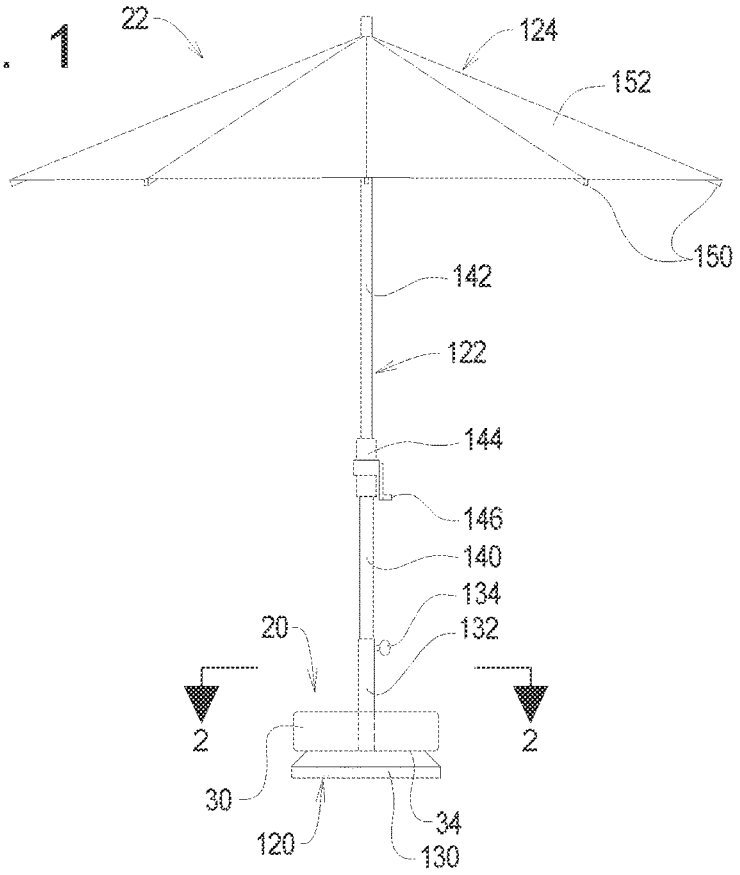
FIG. 1 is a front elevation view of a first example weight system illustrated with a first example umbrella system.
Figure 2:
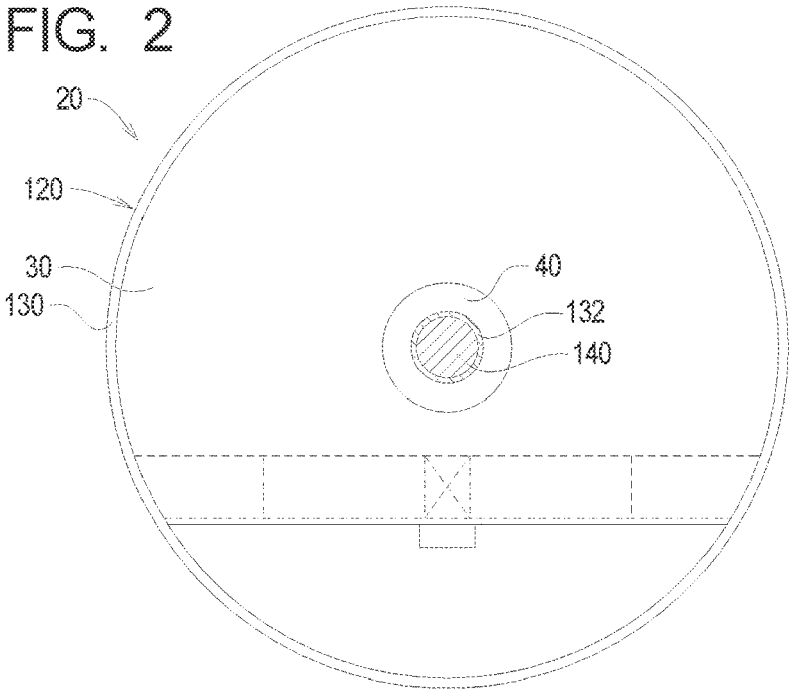
FIG. 2 is a section view taken along lines 2-2 in FIG. 1.
Figure 3:
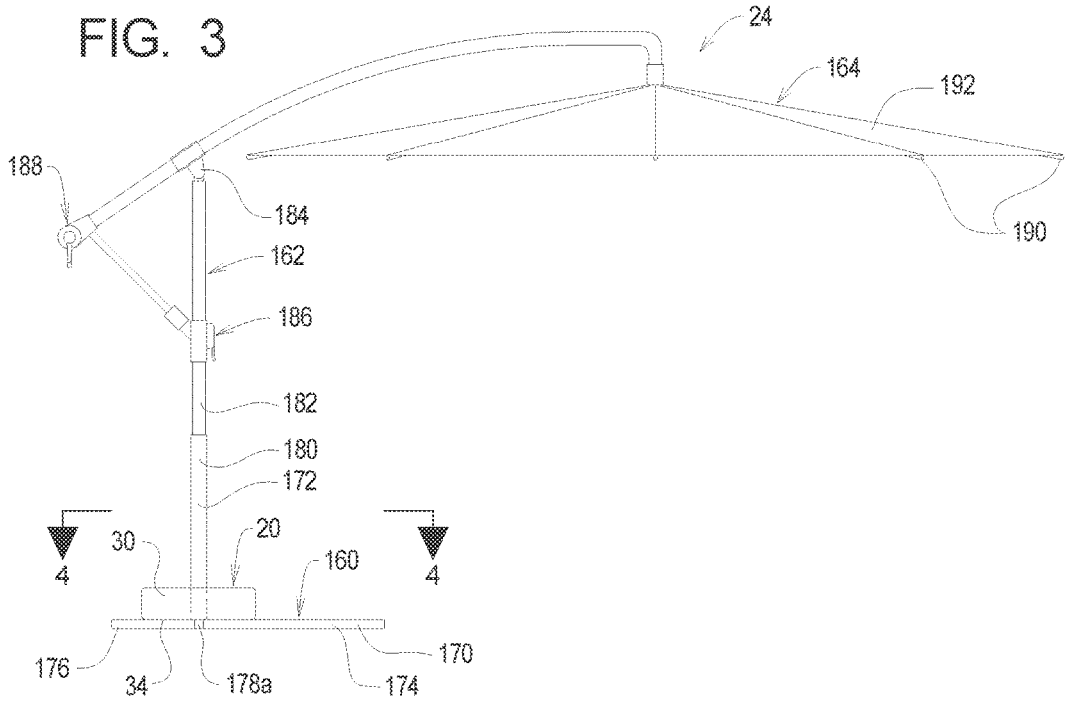
FIG. 3 is a side elevation view of the first example weight system illustrated with a second example umbrella system.
Figure 4:
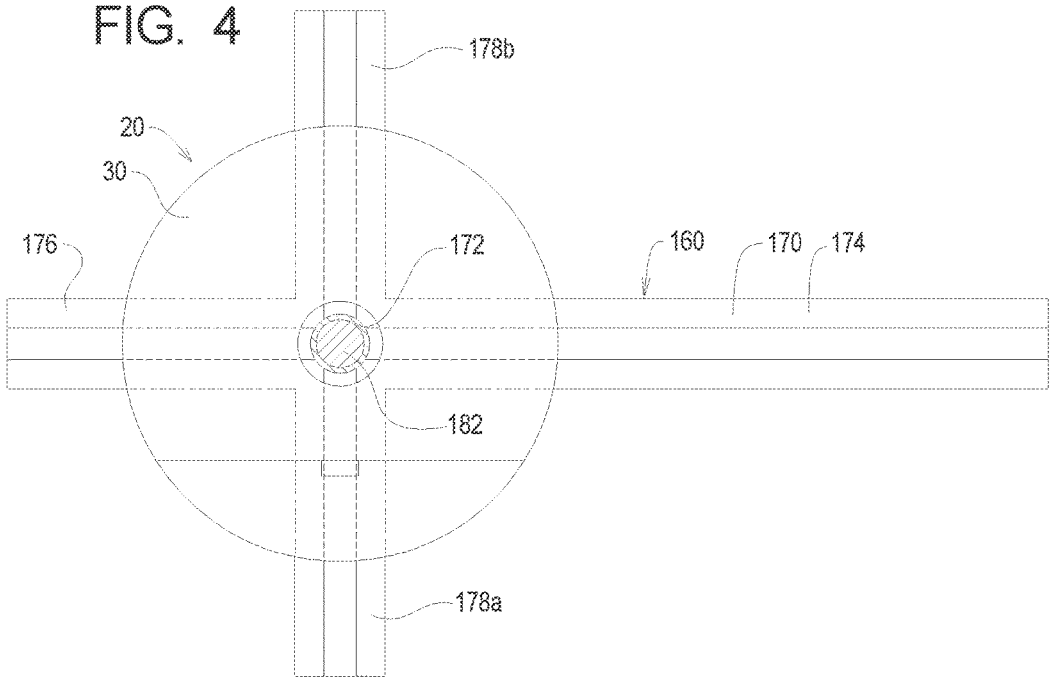
FIG. 4 is a section view taken along lines 4-4 in FIG. 3.
Figure 5:
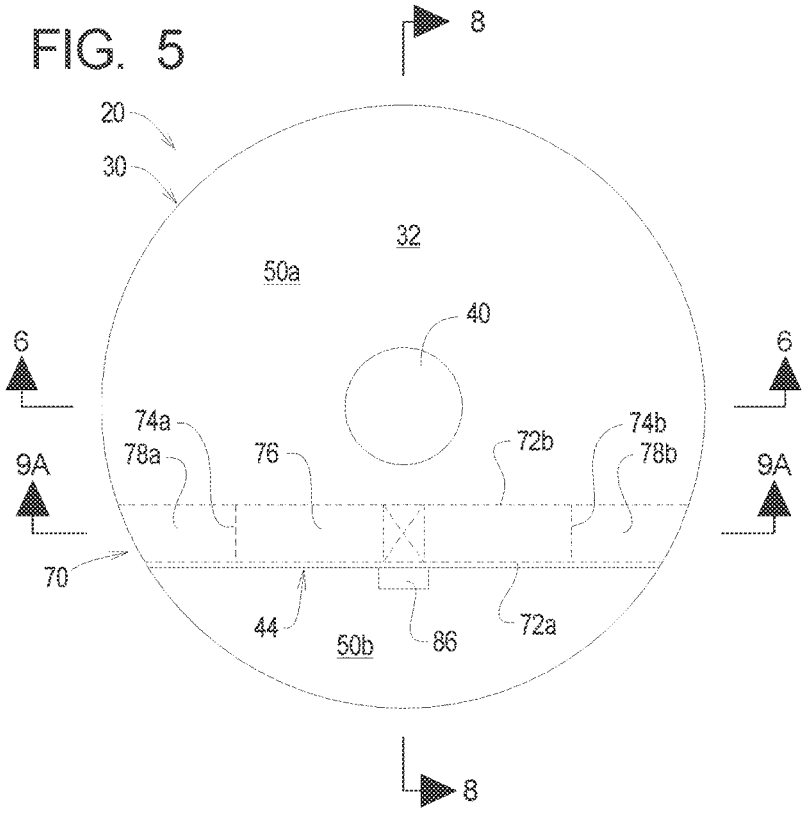
FIG. 5 is a top plan view of the first example weight system.
Figure 6:
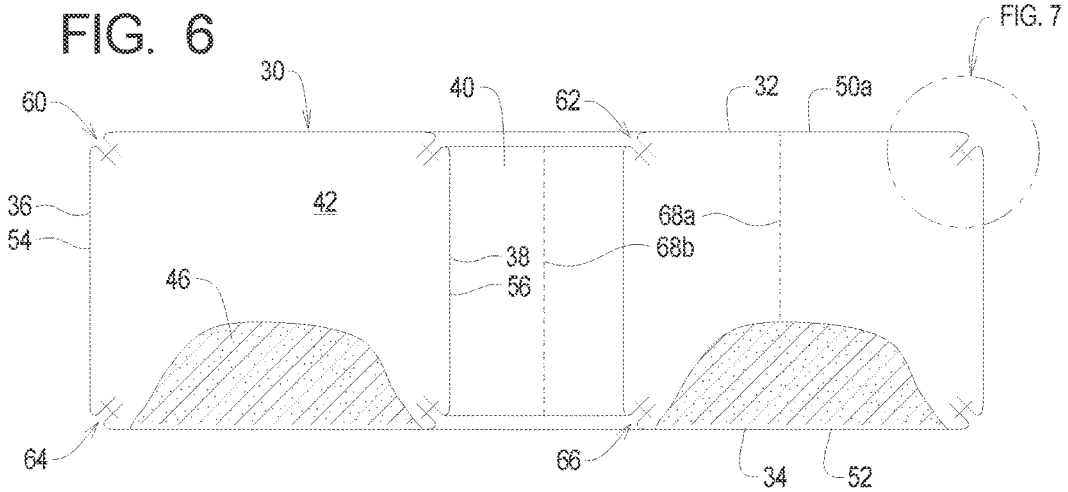
FIG. 6 is a section view taken along lines 6-6 in FIG. 5.

Referring initially to FIGS. 1-4 of the drawing, depicted therein is a first example weight system 20 constructed in accordance with, and embodying, the principles of the present invention. In FIGS. 1 and 2, the first example weight system 20 is shown being used to stabilize a first example umbrella system 22. In FIGS. 3 and 4, the first example weight system 20 is shown being used to stabilize a second example umbrella system 24.

As shown 5-9, the details of the first example weight system 20 will be described in further detail. The first example weight system 20 comprises a weight container 30 defining an upper wall 32, a lower wall 34, an outer side wall 36, and an inner side wall 38. The example upper and lower walls 32 and 34 are flat and disc-shaped, while the outer and inner side walls 36 and 38 are cylindrical. The first example weight system 20 further defines a through hole 40 and an interior chamber 42. A fill opening 44 is formed in the upper wall 32 through which fill material 46 is placed into the interior chamber 42.

The first example weight system 20 comprises first and second upper panels 50*a* and 50*b* defining the upper wall 32, a lower panel 52 defining the lower wall 34, an outer side panel 54 defining the outer side wall 36, and an inner side panel 56 defining the inner side wall 38. The example panels 50*a*, 50*b*, 52, 54, and 56 are made of a flexible fabric capable of containing the fill material 46 and bearing the weight fill material 46 when the weight container 30 is filled with the fill material 46 as will be described in further detail herein. The example first and second upper panels 50*a* and 50*b* are joined to the outer side panel 54 by a first upper seam 60. The example first and second upper panels 50*a* and 50*b* are joined to the inner side panel 56 by a second upper seam 62. The example lower panel 52 is joined to the outer side panel 54 by a first lower seam 64. The example lower panel 52 is also joined to the inner side panel 56 by a second lower seam 66. A first vertical seam 68*a* joins ends of the outer panel 54 to form the outer side wall 36, and a second vertical seam 68*b* joins ends of the inner panel 56 to form the inner side wall 38.

The example first upper panel 50*a* defines an axial hole. A first outer edge of the example first upper panel 50*a* extends partly along a first circular path defining a first diameter. An inner edge of the example first upper panel 50*a* extends along a second circular path defining a second diameter. The length of the second diameter is approximately one tenth of the length of the first diameter. An overlap edge of the example first upper panel 50*a* intersects the first circular path at first and second intersection points. The example first upper panel 50*a* extends along approximately 245 degrees of the first circular path (e.g., between the first and second intersection points defined by the first overlap edge).

The example second upper panel 50*b* defines a second outer edge that also extends partly along the first circular path. A second overlap edge defined by the example second upper panel 50*b* intersects the first circular path at third and fourth intersection points. The example second upper panel 50*b* extends along approximately 140 degrees of the first circular path (e.g., between the third and fourth intersection points defined by the second overlap edge).

Given that the example first upper panel 50*a* extends along approximately 245 degrees of the first circular path and the example second upper panel 50*b* extends along approximately 140 degrees of the first circular path, the example first and second panels 50*a* and 50*b* overlap in an overlap region 70. The example overlap region intersects the first circular path at first and second intersection locations, with each intersecting location extending along approximately 12.5 degrees of the first circular path.

The example first and second upper panels 50*a* and 50*b* are sewn together by the first upper seam 60 within the intersecting locations. The example first and second upper panels 50*a* and 50*b* are further sewn at least partly together by first and second chord stitches 72*a* and 72*b* and first and second end stitches 74*a* and 74*b*. The example first chord stitch 72*a* extends along a line extending between the first and second intersection points, while the example second chord stitch 72*b* extends along a line extending between the second and third intersection points. The example first and second chord stitches 72*a* and 72*b* are parallel to each other. The end stitches 74*a* and 74*b* extend between the first and second chord stitches 72*a* and 72*b* at points that are approximately one fifth of the length of the chords defined by the first and second chord stitches 72*a* and 72*b* from the first and second intersection locations. The example end stitches 74*a* and 74*b* are parallel to each other.

The example chord stitches 72*a* and 72*b* and the example end stitches 74*a* and 74*b* divide the overlap region into a middle portion 76 and first and second end portions 78*a* and 78*b*. Outside of the middle portion 76, the chord stitches 72*a* and 72*b* join the first and second upper panels 50*a* and 50*b* together. Within the middle portion 76, the chord stitches 72*a* and 72*b* do not join the first and second upper panels 50*a* and 50*b* together but simply form seams to finish the edges of the first and second upper panels 50*a* and 50*b*. In particular, the example first chord stitch 72*a* forms a seam edge of the example first upper panel 50*a*, while the example second chord stitch 72*b* forms a seam edge of the example second upper panel 50*b*.

Accordingly, the first and second upper panels 50*a* and 50*b* are effectively sealed together in the first and second end portions 78*a* and 78*b*, but the fill opening 44 is defined between the first and second upper panels 50*a* and 50*b* within the middle portion 76.

Figure 8:
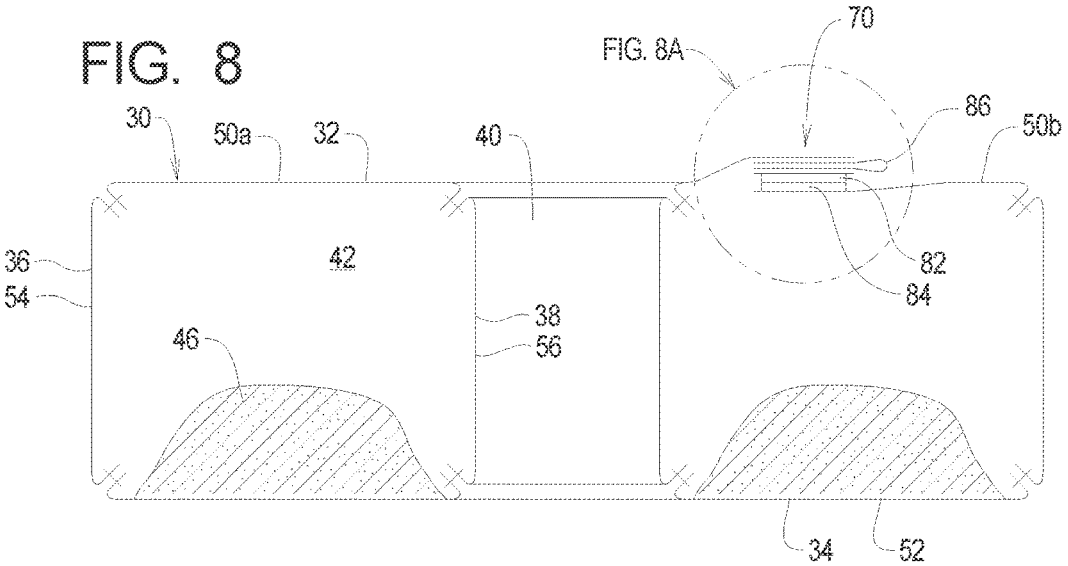
FIG. 8 is a section view taken along lines 8-8 in FIG. 5.
Figure 8A:
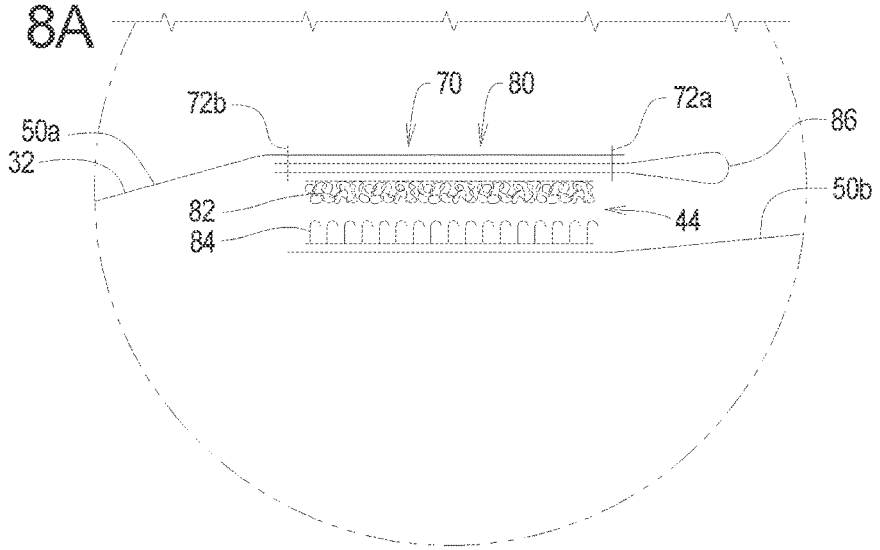
FIG. 8A is a detail of a portion of FIG. 8.

Referring now to FIGS. 8 and 8A, it can be seen that a closure system 80 is arranged to detachably attach the first and second upper panels 50*a* and 50*b* within the middle portion 76 to close the fill opening 44. The example closure system 80 is a hook and loop system, but other closure systems such as lacing, a zipper, or the like may be used in addition or instead. If the closure system used is not a hook and loop system (e.g., uses a zipper and/or laces), the first and second upper panels 50*a* and 50*b* need not overlap. Instead the fill opening 44 may be formed by may be joined at seams formed by edges of the respective panels 50*a* and 50*b*, with the zipper and/or laces joining the panels 50*a* and 50*b* together at the adjacent seams. However, the use of overlapping panels 50*a* and 50*b* creates a finished look that also allows the closure system (hook and loop, zipper, and/or laces) to be hidden from view during normal use of the example container 30 as part of the example weight system 20.

Figure 9A:
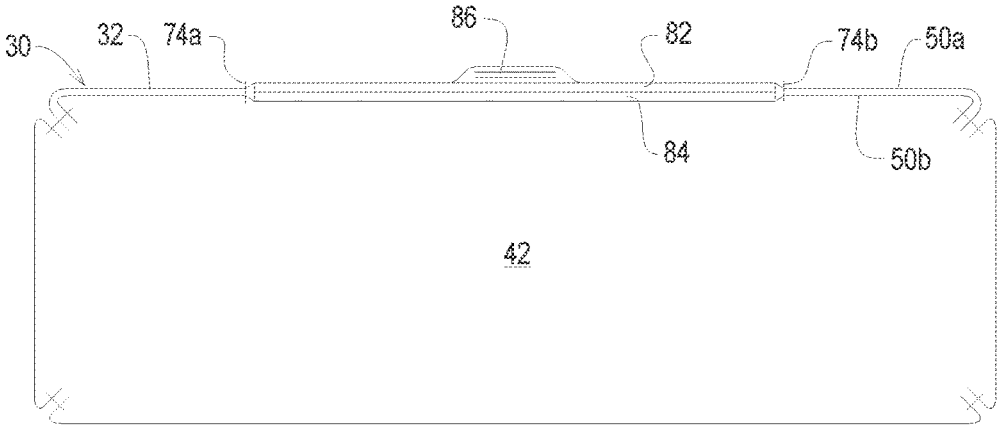
FIG. 9A is a section view taken along lines 9A-9A in FIG. 5 illustrating the first example weight container of the first example weight system in a closed configuration.
Figure 9B:
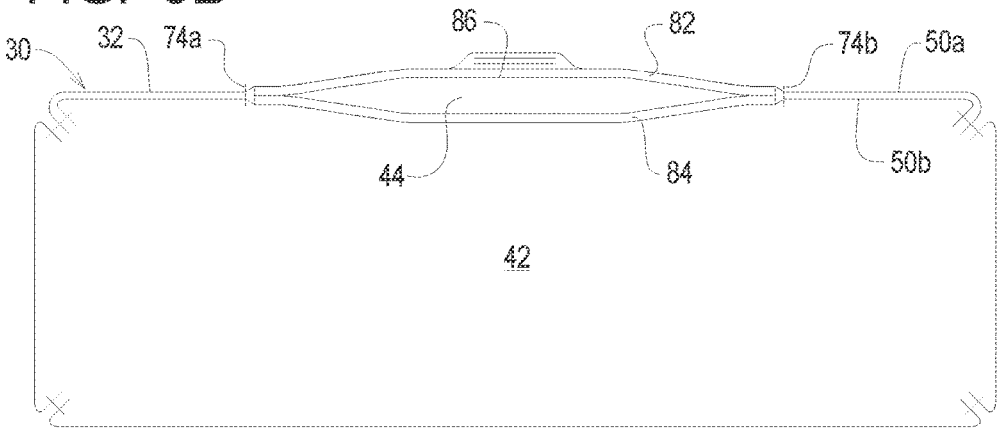
FIG. 9B is a section view similar to FIG. 9A illustrating the first example weight container of the first example weight system in an open configuration.
Figure 10:
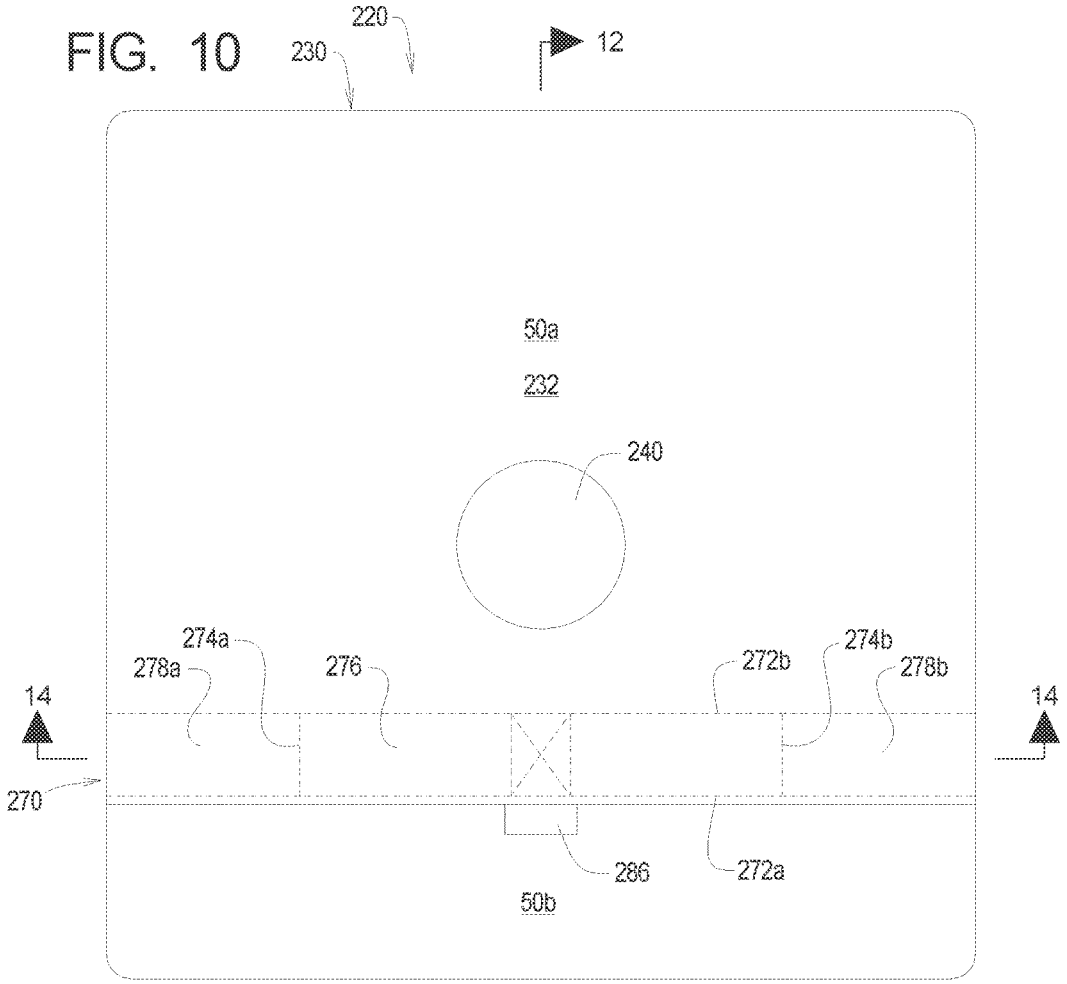
FIG. 10 is a top plan view of a second example weight system.
Figure 11:
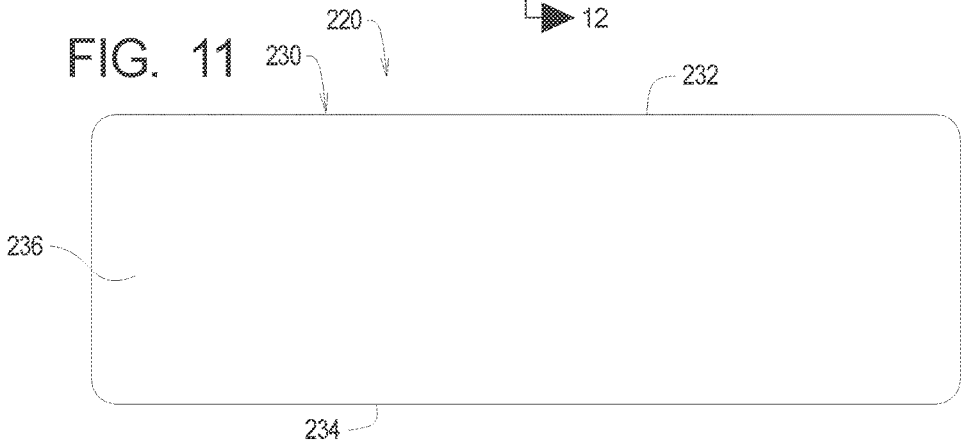
FIG. 11 is a front elevation view of the second example weight system.

The example hook and loop system forming the closure system 80 comprises a loop panel 82 secured to the first upper panel 50*a* within the middle portion 76 and a hook panel 84 secured to the second upper panel 50*b*, also within the middle portion 76. The loop panel 82 overlaps the hook panel 84 to effectively seal the first and second upper panels 50*a* and 50*b* together. More specifically, when the loop panel 82 is attached to the hook panel 84 as shown in FIGS. 8 and 9A, the weight container 30 is in a closed configuration in which access to the interior chamber 42 through the fill opening 44 is prevented. When the loop panel 82 is detached from the hook panel 84 as shown in FIGS. 8A and 9B, the weight container 30 is in an open configuration in which access to the interior chamber 42 is allowed through the fill opening 44. The fill material 46 may be poured or otherwise passed through the fill opening 44 in the open configuration to allow the interior chamber 42 to be filled and/or emptied. A tab 86 may be secured to the first upper panel 50*a* to facilitate detachment of the hook panel 84 from the loop panel 82 and thus placement of the weight container 30 in the open configuration.

Figure 7:
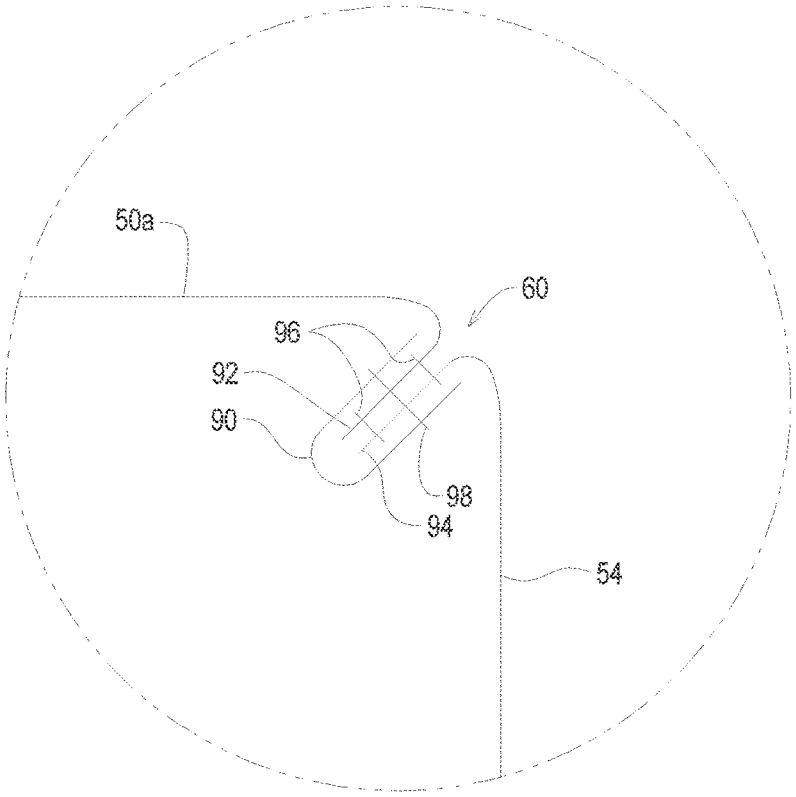
FIG. 7 is a detail of a portion of FIG. 6.

FIG. 7 illustrates a detail of the example first upper seam 60. The detail of FIG. 7 applies to all of the example second upper seam 62, first lower seam 64, and second lower seam 66, and only the example first upper seam 60 will be described herein in detail.

In particular, FIG. 7 illustrates that the example weight container 30 further comprises an edge panel 90. As shown in FIG. 7, the first upper panel 50*a* defines a first edge 92 and the outer side panel 54 defines a second edge 94. To form the example first upper seam 60, the first and second edges 92 and 94 are sewn together using a double stitch 96. After the double stitch 96 is formed, the edge panel 90 is folded over the first and second edges 92 and 94. The edge panel 90 is then sewn to the first and second edges 92 and 94 by a single stitch 98 that extends through one portion of the edge panel 90, the first edge 92, the second edge 94, and a second portion of the edge panel 90. The edge panel 90 is formed of thick strapping or other strong, flexible fabric material capable of reinforcing the first upper seam 60 and also of inhibiting the passage of the fill material 46 out of the interior chamber 42 through this seam 60.

To fill the weight container 30, the hook panel 84 is disengaged from the loop panel 82 to place the weight container 30 in its open configuration. In this open configuration, the fill material 46 is poured or otherwise passed through the fill opening 44 until a desired amount of fill material 46 is within the interior chamber 42. During normal use of the first example weight system 20, the hook panel 84 engages the loop panel 82 substantially to prevent the fill material 46 from being displaced out of the interior chamber 42 through the fill opening 44. The weight container 30 may be arranged in a desired relationship to the item to be supported prior to introduction of the fill material 46 into the interior chamber 42 to minimize carrying of the fully loaded weight container 30.

While a number of materials may be used to satisfy the functional requirements of the example weight container 30, the following materials have been determined to provide a good balance of functionality and cost.

The material forming the example panels 50*a*, 50*b*, 52, 54, and 56 is a polyester fabric. The example polyester fabric used is a 600 D×600 D rip stop polyester, cross hatch ⅝" grid at 300 grams per square yard, with a PVC lining facing the interior chamber 42. This panel material is waterproof, inhibits separation along all edges of the weight container 30, and inhibits migration of the fill material 46 through the fabric forming the 50*a*, 50*b*, 52, 54, and 56.

The example thread used to form the seams 60, 62, 64, 66, 68*a*, and 68*b*, stitches 72*a*, 72*b*, 74*a*, 74*b*, 96, and 98, and to secure the loop panel 82 and hook panel 84 to the panels 50*a* and 50*b* is polyester thread. The example polyester thread is #606 polyester heavy duty thread.

The example loop panel 82 and hook panel 84 are 2.0" polyester hook and loop material (e.g., VELCRO™) class level A.

The example tab 86 is formed of polyester webbing. The polyester webbing forming the example tab 86 is 1.5" polyester webbing.

The example edge panel 90 is formed by polyester bias tape. The example polyester bias tape forming the example edge panel 90 is ⅞" polyester bias tape with flat press finish at 6.5 grams per yard.

Referring now again to FIGS. 1 and 3, the first and second example umbrella systems 22 and 24 will be described in further detail to illustrate several examples of use of the example weight systems described herein. The umbrella systems 22 and 24 are or may be conventional and are described herein only to that extent helpful to a complete understanding of the use of the present invention.

The first example umbrella system 22 comprises a base assembly 120, a pole assembly 122, and a canopy assembly 124. The base assembly 120 comprises a base structure 130, a base stem 132, and a base lock 134. The pole assembly 122 comprises a lower pole 140, an upper pole 142, a tilt assembly 144, and a crank assembly 146. The canopy assembly 124 comprises canopy rods 150 and a canopy 152 formed of flexible material.

The base structure 130 defines a lower surface that engages the ground and an upper surface. The base stem 132 extends upwards from the upper surface of the base structure 130. The lower pole 140 is received by the base stem 132. The tilt assembly 144 connects the upper pole 142 to lower pole 140 such that an angle of the upper pole 142 with respect to the lower pole 140 may be changed. The canopy rods 150 are pivotably supported by the upper pole 142, and operation of the crank assembly 146 moves the canopy rods 150 between retracted and extended positions.

To use the first example weight system 20 to support the first example umbrella system 22, the base assembly 120 is arranged at a desired location. The weight container 30 is then arranged such that the base stem 132 of the base structure 130 extends through the through hole 40 in the weight container 30 and the lower wall 34 of the weight container 30 rests on the upper surface of the base structure 130. The weight container 30 is placed in its open configuration, and the desired amount of fill material 46 is arranged within the interior chamber 42 through the fill opening 44. The weight container 30 is then placed in its closed configuration. At this point, the weight of the weight container 30 and the fill material 46 contained by the weight container 30 will apply a downward force on the base structure 130.

The desired amount of fill material 46 will depend upon the nature of the fill material and the specifics of the first example umbrella system 22. The fill material 46 may be placed into the interior chamber 42 before arranging the through hole 40 of the weight container 30 to receive the base stem 132, but may require lifting and moving of the entire first example weight system 20.

The second example umbrella system 24 comprises a base assembly 160, a pole assembly 162, and a canopy assembly 164. The example base assembly 160 comprises a base structure 170 and a base stem 172. The example base structure 170 comprises a forward leg 174, a rear leg 176, and first and second transverse legs 178*a* and 178*b*. The pole assembly 162 comprises a lower pole 180, an upper pole 182, a pivot support 184, a tilt assembly 186, and a crank assembly 188. The canopy assembly 164 comprises canopy rods 190 and a canopy 192 formed of flexible material.

The legs 174, 176, 178*a*, and 178*b* define lower surfaces that engages the ground and upper surfaces. The base stem 172 extends upwards from the base structure 170 at the intersection of the legs 174, 176, 178*a*, and 178*b*. The lower pole 180 is received by the base stem 172. The tilt assembly 186 connects the upper pole 182 to lower pole 180 such that an angle of the upper pole 182 with respect to the lower pole 180 may be changed and such that the upper pole 182 extends from the lower pole 180. The canopy rods 190 are pivotably supported by the upper pole 182, and operation of the crank assembly 188 moves the canopy rods 190 between retracted and extended positions.

To use the first example weight system 20 to support the second example umbrella system 24, the base assembly 160 is arranged at a desired location. The weight container 30 is then arranged such that the base stem 172 of the base structure 170 extends through the through hole 40 in the weight container 30 and the lower wall 34 of the weight container 30 rests on the upper surfaces of at least some of the legs 174, 176, 178*a*, and 178*b*. The weight container 30 is placed in its open configuration, and the desired amount of fill material 46 is arranged within the interior chamber 42 through the fill opening 44. The weight container 30 is then placed in its closed configuration. At this point, the weight of the weight container 30 and the fill material 46 contained by the weight container 30 will apply a downward force on the base structure 160.

The desired amount of fill material 46 will depend upon the nature of the fill material and the specifics of the second example umbrella system 24. The fill material 46 may be placed into the interior chamber 42 before arranging the through hole 40 of the weight container 30 to receive the base stem 172, but may require lifting and moving of the entire first example weight system 20.

Although the example weight container 30 is substantially round in top plan view and forms a hollow cylinder, other shapes may be used, several examples of which are described elsewhere in this application.

II. Second Embodiment

Referring now to FIGS. 10-15 of the drawing, depicted therein is a second example weight system 220 constructed in accordance with, and embodying, the principles of the present invention. The second example weight system 220 comprises a weight container 230 defining an upper wall 232, a lower wall 234, an outer side wall 236, and an inner side wall 238. The example upper and lower walls 232 and 234 are flat and rectangular (square), the outer side wall 236 comprises four flat segments, and the inner side wall 238 is cylindrical. The second example weight system 220 further defines a through hole 240 and an interior chamber 242. A fill opening 244 is formed in the upper wall 232 through which fill material 246 is placed into the interior chamber 242.

The second example weight system 220 comprises first and second upper panels 250*a* and 250*b* defining the upper wall 232, a lower panel 252 defining the lower wall 234, an outer side panel 254 defining the outer side wall 236, and an inner side panel 256 defining the inner side wall 238. The example panels 250*a*, 250*b*, 252, 254, and 256 are made of a flexible fabric capable of containing the fill material 246 and bearing the weight fill material 246 when the weight container 230 is filled with the fill material 246 as will be described in further detail herein. The example first and second upper panels 250*a* and 250*b* are joined to the outer side panel 254 by a first upper seam 260. The example first and second upper panels 250*a* and 250*b* are joined to the inner side panel 256 by a second upper seam 262. The example lower panel 252 is joined to the outer side panel 254 by a first lower seam 264. The example lower panel 252 is also joined to the inner side panel 256 by a second lower seam 266. A first vertical seam 268*a* joins ends of the outer side panel 254 to form the outer side wall 236, and a second vertical seam 268*b* joins ends of the inner panel 256 to form the inner side wall 238. The example first upper seam 260, second upper seam 262, first lower seam 264, and second lower seam 266 may be constructed in the same manner as the example first upper seam 60 described above and will not be described herein in further detail.

The example first upper panel 250*a* defines an axial hole. A first outer edge of the example first upper panel 250*a* extends partly along a segmented path. An inner edge of the example first upper panel 250*a* extends along a circular path defining a diameter. The length of the diameter is approximately one tenth of the length between opposing sides of the first upper panel 250*a*. A first overlap edge of the example first upper panel 250*a* intersects the segmented path defined by the first upper panel 250*a* at first and second intersection points. The first overlap edge of the example first upper panel 250*a* is offset from the axial hole.

The example second upper panel 250*b* defines a second outer edge that also extends partly along the segmented path. A second overlap edge defined by the example second upper panel 250*b* intersects the segmented path at third and fourth intersection points. When the example weight container 230 is assembled, the third and fourth intersection points defined by the second overlap edge are arranged between a line extending between the first and second intersection points and the axial hole defined by the first upper panel 250*a*.

With the foregoing construction, the second overlap edge defined by the second upper panel 250*b* is arranged between the first overlap edge and the through hole 240. Accordingly, the example first and second panels 250*a* and 250*b* overlap in an overlap region 270. The example overlap region intersects the segmented path at first and second intersection locations.

The example first and second upper panels 250*a* and 250*b* are sewn together by the first upper seam 260 within the intersecting locations. The example first and second upper panels 250*a* and 250*b* are further sewn at least partly together by first and second lateral stitches 272*a* and 272*b* and first and second end stitches 274*a* and 274*b*. The example first lateral stitch 272*a* extends along a line extending between the first and second intersection points, while the example second lateral stitch 272*b* extends along a line extending between the second and third intersection points. The example first and second lateral stitches 272*a* and 272*b* are parallel to each other. The example end stitches 274*a* and 274*b* extend between the first and second lateral stitches 272*a* and 272*b* at points that are approximately one fifth of the length of the chords defined by the first and second lateral stitches 272*a* and 272*b* from the first and second intersection locations. The example end stitches 274*a* and 274*b* are parallel to each other.

The example lateral stitches 272*a* and 272*b* and the example end stitches 274*a* and 274*b* divide the overlap region into a middle portion 276 and first and second end portions 278*a* and 278*b*. Outside of the middle portion 276, the lateral stitches 272*a* and 272*b* join the first and second upper panels 250*a* and 250*b* together. Within the middle portion 276, the lateral stitches 272*a* and 272*b* do not join the first and second upper panels 250*a* and 250*b* together but simply form seams to finish the edges of the first and second upper panels 250*a* and 250*b*. In particular, the example first lateral stitch 272*a* forms a seam edge of the example first upper panel 250*a*, while the example second lateral stitch 272*b* forms a seam edge of the example second upper panel 250*b*.

Accordingly, the first and second upper panels 250*a* and 250*b* are effectively sealed together in the first and second end portions 278*a* and 278*b*, but the fill opening 244 is defined between the first and second upper panels 250*a* and 250*b* within the middle portion 276.

Figure 12:
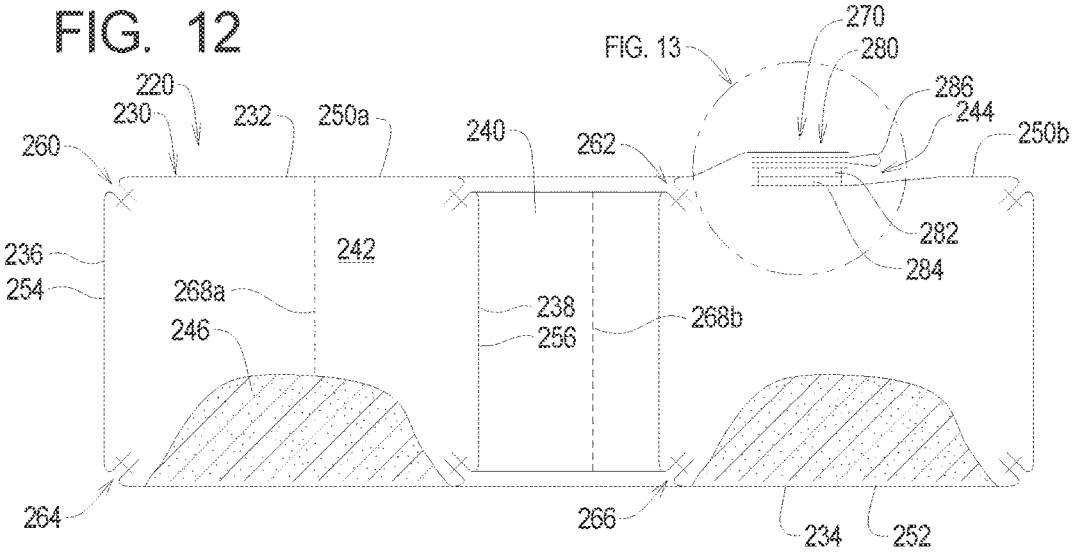
FIG. 12 is a section view taken along lines 12-12 in FIG. 10.
Figure 13:
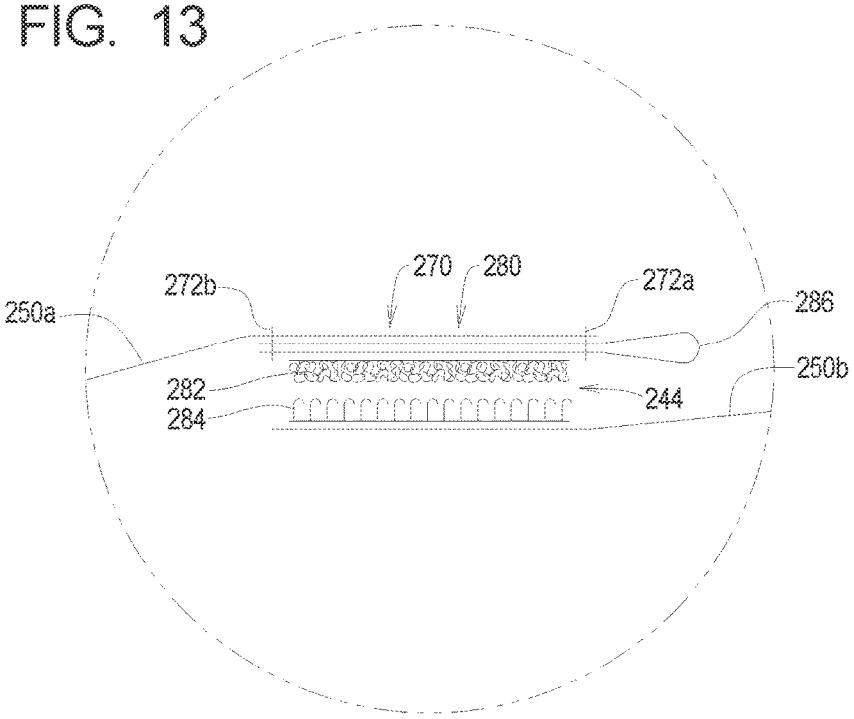
FIG. 13 is a detail of a portion of FIG. 12.

Referring more specifically to FIGS. 12 and 13, it can be seen that a closure system 280 is arranged to detachably attach the first and second upper panels 250*a* and 250*b* within the middle portion 276 to close the fill opening 244. The example closure system 280 is a hook and loop system, but other closure systems such as lacing, a zipper, or the like may be used in addition or instead. If the closure system used is not a hook and loop system (e.g., a zipper or laces), the first and second upper panels 250*a* and 250*b* need not overlap. Instead the fill opening 244 may be formed by may be joined at seams formed by edges of the respective panels 250*a* and 250*b*, with the zipper and/or laces joining the panels 250*a* and 250*b* together at the adjacent seams.

Figure 14:
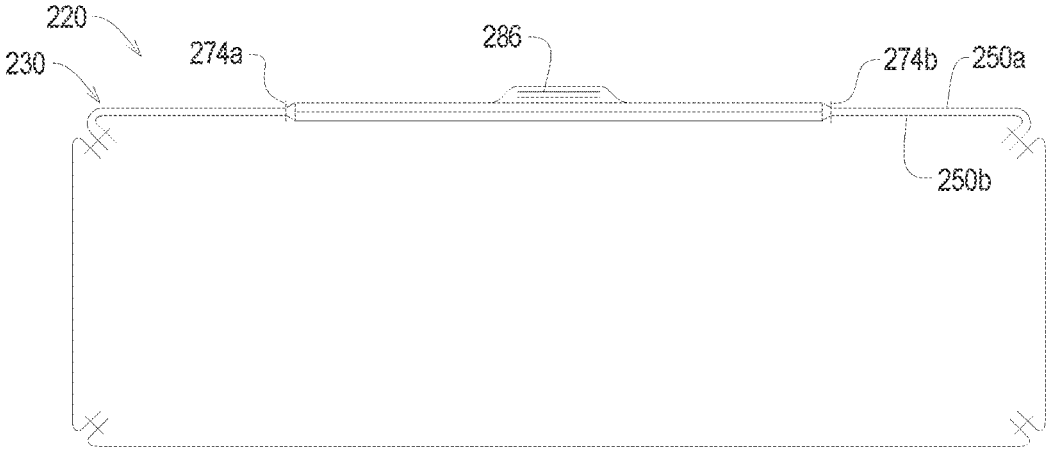
FIG. 14 is a section view taken along lines 14-14 in FIG. 10 illustrating a second example weight container of the second example weight system in a closed configuration.
Figure 15:
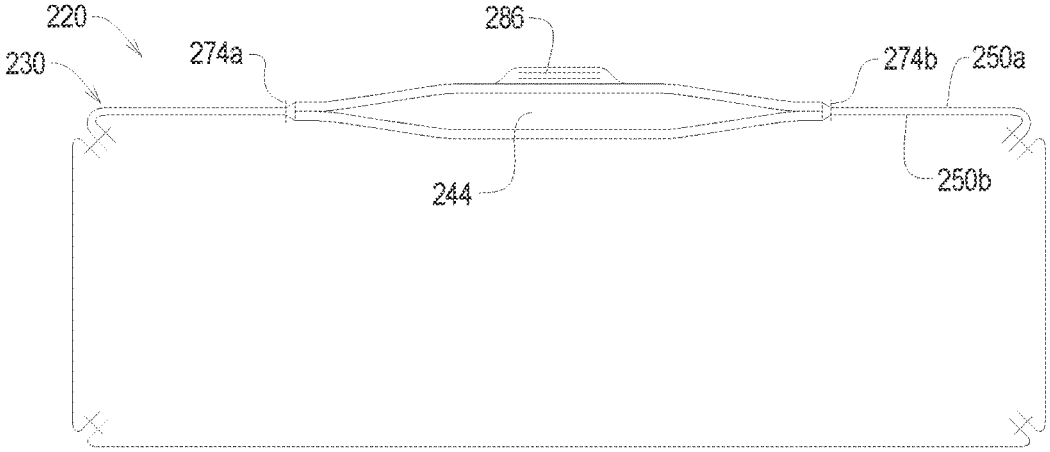
FIG. 15 is a section view similar to FIG. 14 illustrating the second example weight container of the second example weight system an open configuration.

The example hook and loop system forming the closure system 280 comprises a loop panel 282 secured to the first upper panel 250*a* within the middle portion 276 and a hook panel 284 secured to the second upper panel 250*b* within the middle portion 276. The loop panel 282 overlaps the hook panel 284 to effectively seal the first and second upper panels 250*a* and 250*b* together. More specifically, when the loop panel 282 is attached to the hook panel 284 as shown in FIGS. 12 and 14, the weight container 230 is in a closed configuration in which access to the interior chamber 242 through the fill opening 244 is prevented. When the loop panel 282 is detached from the hook panel 284 as shown in FIGS. 13 and 15, the weight container 230 is in an open configuration in which access to the interior chamber 242 is allowed through the fill opening 244. The fill material 246 may be poured or otherwise passed through the fill opening 244 in the open configuration to allow the interior chamber 242 to be filled and/or emptied. A tab 286 may be secured to the first upper panel 250*a* to facilitate detachment of the hook panel 284 from the loop panel 282 and thus placement of the weight container 230 in the open configuration.

To fill the weight container 230, the hook panel 284 is disengaged from the loop panel 282 to place the weight container 230 in its open configuration. In this open configuration, the fill material 246 is poured or otherwise passed through the fill opening 244 until a desired amount of fill material 246 is within the interior chamber 242. During normal use of the second example weight system 220, the hook panel 284 engages the loop panel 282 substantially to prevent the fill material 246 from being displaced out of the interior chamber 242 through the fill opening 244. The weight container 230 may be arranged in a desired relationship to the item to be supported prior to introduction of the fill material 246 into the interior chamber 242 to minimize carrying of the fully loaded weight container 230.

While a number of materials may be used to satisfy the functional requirements of the second example weight container 230, the materials described above with respect to the first example weight container 30 have been determined to provide a good balance of functionality and cost and may also be used to form like components of the second example container 230.

The second example weight system 220 may be used to support either of the first and second example umbrella systems 22 and 24 or possibly other upright items such as construction or traffic cones, light poles, portable pole mounted heaters, or the like.

To use the second example weight system 220 to support the first example umbrella system 22, the base assembly 120 is arranged at a desired location. The weight container 230 is then arranged such that the base stem 132 of the base structure 130 extends through the through hole 240 in the weight container 230 and the lower wall 234 of the weight container 230 rests on the upper surface of the base structure 130. The weight container 230 is placed in its open configuration, and the desired amount of fill material 246 is arranged within the interior chamber 242 through the fill opening 244. The weight container 230 is then placed in its closed configuration. At this point, the weight of the weight container 230 and the fill material 246 contained by the weight container 230 will apply a downward force on the base structure 130.

The desired amount of fill material 246 will depend upon the nature of the fill material and the specifics of the first example umbrella system 22. The fill material 246 may be placed into the interior chamber 242 before arranging the through hole 240 of the weight container 230 to receive the base stem 132, but may require lifting and moving of the entire second example weight system 220.

To use the second example weight system 220 to support the second example umbrella system 22, the base assembly 160 is arranged at a desired location. The weight container 230 is then arranged such that the base stem 172 of the base structure 170 extends through the through hole 240 in the weight container 230 and the lower wall 234 of the weight container 230 rests on the upper surfaces of at least some of the legs 174, 176, 178*a*, and 178*b*. The weight container 230 is placed in its open configuration, and the desired amount of fill material 246 is arranged within the interior chamber 242 through the fill opening 244. The weight container 230 is then placed in its closed configuration. At this point, the weight of the weight container 230 and the fill material 246 contained by the weight container 230 will apply a downward force on the base structure 160.

The desired amount of fill material 246 will depend upon the nature of the fill material and the specifics of the second example umbrella system 24. The fill material 246 may be placed into the interior chamber 242 before arranging the through hole 240 of the weight container 230 to receive the base stem 172, but may require lifting and moving of the entire second example weight system 220.

Although the example weight container 230 is substantially square in top plan view and forms rectangular solid with a central hole, other shapes may be used, several examples of which are described elsewhere in this application.

III. Third Embodiment

Figure 16:
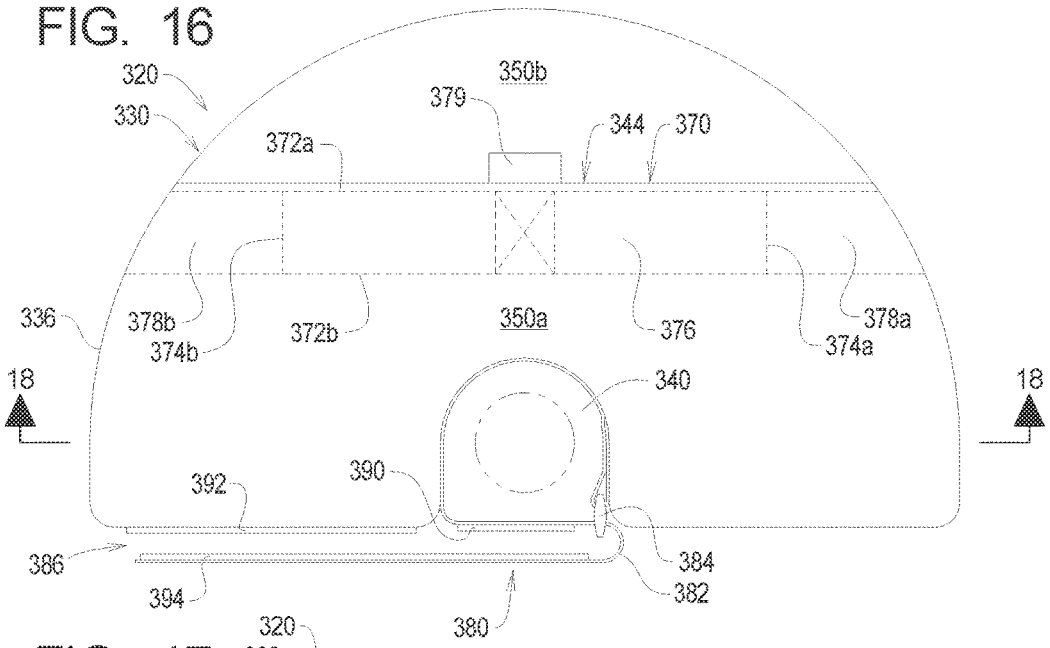
FIG. 16 is a top plan view of a third example weight system.
Figure 17:
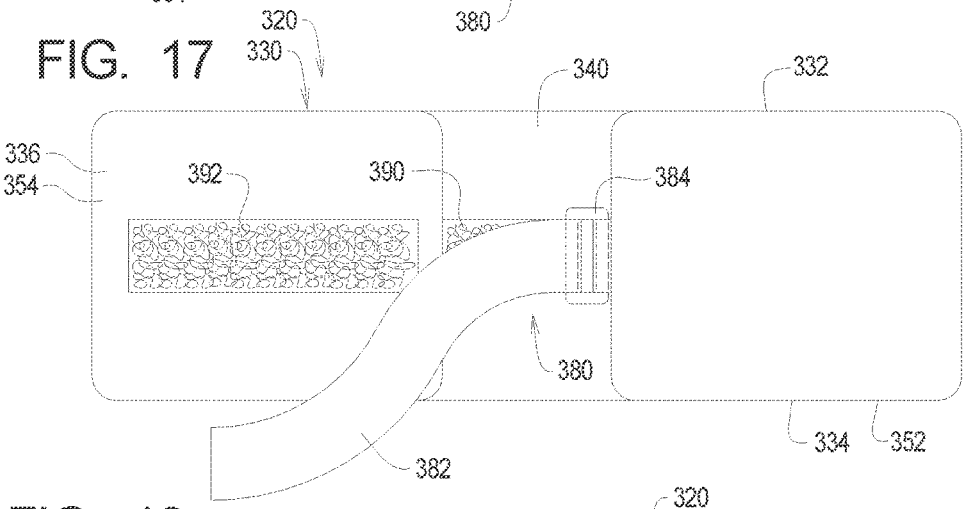
FIG. 17 is a front elevation view of the third example weight system.
Figure 18:
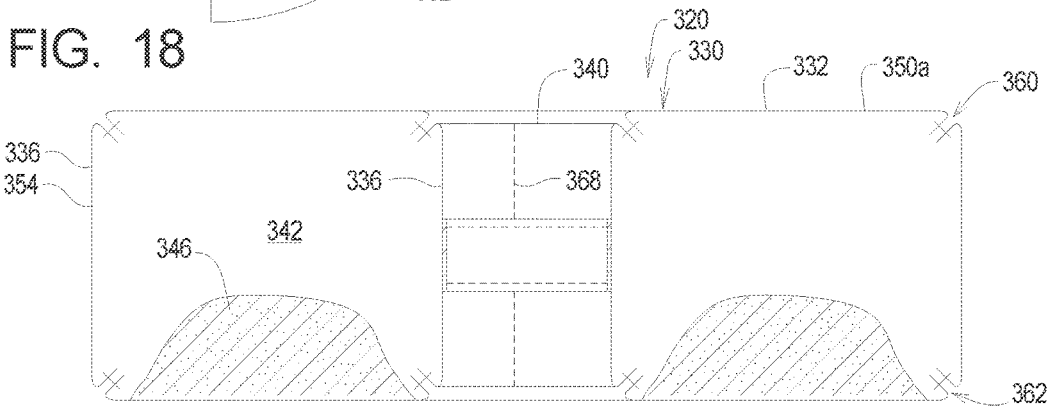
FIG. 18 is a section view taken along lines 18-18 in FIG. 16.

Referring now to FIGS. 16-18 of the drawing, depicted therein is a third example weight system 320 constructed in accordance with, and embodying, the principles of the present invention. The third example weight system 320 comprises a weight container 330 defining an upper wall 332, a lower wall 334, and a side wall 336. The example upper and lower walls 332 and 334 are flat and semi-circular but could be rectangular or other shapes. The example side wall 336 comprises a first semi-cylindrical segment, first and second flat segments, and a second semi-cylindrical segment. The diameter defined by the first semi-cylindrical segment is larger than that defined by the second semi-cylindrical segment. Each of the first and second flat segments extends between the first and second semi-cylindrical segments. The third example weight system 320 further defines a notch 340 and an interior chamber 342. A fill opening 344 is formed in the upper wall 332 through which fill material 346 is placed into the interior chamber 342.

The third example weight system 320 comprises first and second upper panels 350*a* and 350*b* defining the upper wall 332, a lower panel 352 defining the lower wall 334, and a side panel 354 defining the side wall 336. The example panels 350*a*, 350*b*, 352, and 354 are made of a flexible fabric capable of containing the fill material 346 and bearing the weight fill material 346 when the weight container 330 is filled with the fill material 346 as will be described in further detail herein. The example first and second upper panels 350*a* and 350*b* are joined to the side panel 354 by an upper seam 360. The example lower panel 352 is joined to the side panel 354 by a lower seam 362. A vertical seam 368 joins ends of the side panel 354 to form the side wall 236. The example upper seam 360 and lower seam 362 may be constructed in the same manner as the example first upper seam 60 described above and will not be described herein in further detail.

A first outer edge of the example first upper panel 350*a* extends along a portion of a segmented path defined by the side wall 336. A first overlap edge of the example first upper panel 350*a* intersects the segmented path defined by the first upper panel 350*a* at first and second intersection points.

The example second upper panel 350*b* defines a second outer edge that also extends partly along the segmented path. A second overlap edge defined by the example second upper panel 350*b* intersects the segmented path at third and fourth intersection points. When the example weight container 330 is assembled, the third and fourth intersection points defined by the second overlap edge are arranged between a line extending between the first and second intersection points and the notch 340.

With the foregoing construction, the second overlap edge defined by the second upper panel 350*b* is arranged between the first overlap edge and the notch 340. Accordingly, the example first and second panels 350*a* and 350*b* overlap in an overlap region 370. The example overlap region intersects the segmented path at first and second intersection locations.

The example first and second upper panels 350*a* and 350*b* are sewn together by the first upper seam 360 within the intersecting locations. The example first and second upper panels 350*a* and 350*b* are further sewn at least partly together by first and second chord stitches 372*a* and 372*b* and first and second end stitches 374*a* and 374*b*. The example first chord stitch 372*a* extends along a line extending between the first and second intersection points, while the example second chord stitch 372*b* extends along a line extending between the second and third intersection points. The example first and second chord stitches 372*a* and 372*b* are parallel to each other. The example end stitches 374*a* and 374*b* extend between the first and second chord stitches 372*a* and 372*b* at points that are approximately one fifth of the length of the chords defined by the first and second chord stitches 372*a* and 372*b* from the first and second intersection locations. The example end stitches 374*a* and 374*b* are parallel to each other.

The example chord stitches 372*a* and 372*b* and the example end stitches 374*a* and 374*b* divide the overlap region into a middle portion 376 and first and second end portions 378*a* and 378*b*. Outside of the middle portion 376, the chord stitches 372*a* and 372*b* join the first and second upper panels 350*a* and 350*b* together. Within the middle portion 376, the chord stitches 372*a* and 372*b* do not join the first and second upper panels 350*a* and 350*b* together but simply form seams to finish the edges of the first and second upper panels 372*a* and 372*b*. In particular, the example first chord stitch 372*a* forms a seam edge of the example first upper panel 350*a*, while the example second chord stitch 372*b* forms a seam edge of the example second upper panel 350*b*.

Accordingly, the first and second upper panels 350*a* and 350*b* are effectively sealed together in the first and second end portions 378*a* and 378*b*, but the fill opening 344 is defined between the first and second upper panels 350*a* and 350*b* within the middle portion 376.

A closure system (not visible) is arranged to detachably attach the first and second upper panels 350*a* and 350*b* within the middle portion 376 to close the fill opening 344. The example closure system is, like the example closure systems 80 and 280 described above, a hook and loop system, but other closure systems such as lacing, a zipper, or the like may be used in addition or instead. If the closure system used is not a hook and loop system (e.g., a zipper or laces), the first and second upper panels 350*a* and 350*b* need not overlap. Instead the fill opening 344 may be formed by may be joined at seams formed by edges of the respective panels 350*a* and 350*b*, with the zipper and/or laces joining the panels 350*a* and 350*b* together at the adjacent seams.

The example hook and loop system forming the closure system of the third example weight assembly 320 comprises comprising a loop panel (not visible) secured to the first upper panel 350*a* within the middle portion 376 and a hook panel (not visible) secured to the second upper panel 350*b* within the middle portion 376. The loop panel overlaps the loop panel to effectively seal the first and second upper panels 350*a* and 350*b* together. More specifically, when the loop panel is attached to the hook panel, the weight container 330 is in a closed configuration in which access to the interior chamber 342 through the fill opening 344 is prevented. When the loop panel is detached from the hook panel, the weight container 330 is in an open configuration in which access to the interior chamber 342 is allowed through the fill opening 344. The fill material 346 may be poured or otherwise passed through the fill opening 344 in the open configuration to allow the interior chamber 342 to be filled and/or emptied. A tab 379 may be secured to the first upper panel 350*a* to facilitate detachment of the hook panel from the loop panel and thus placement of the weight container 330 in the open configuration.

To fill the weight container 330, the hook panel is disengaged from the loop panel to place the weight container 330 in its open configuration. In this open configuration, the fill material 346 is poured or otherwise passed through the fill opening 344 until a desired amount of fill material 346 is within the interior chamber 342. During normal use of the third example weight system 320, the hook panel engages the loop panel substantially to prevent the fill material 346 from being displaced out of the interior chamber 342 through the fill opening 344. The weight container 330 may be arranged in a desired relationship to the item to be supported prior to introduction of the fill material 346 into the interior chamber 342 to minimize carrying of the fully loaded weight container 330.

The third example weight system 320 further comprises a securing system 380 comprising a pole strap 382, a pole ring 384, and a fastening system 386. The pole strap 382 is secured to the side panel 354 such that the first pole strap 382 extends from the weight container 330 adjacent to the notch 340. In particular, a fixed end portion of the pole strap 382 is secured to the side panel 354 within the notch 340 such that a free end portion of the strap extends from the weight container 330 such that the free end portion strap can be extended from the first flat segment of the side wall 336 to the second flat segment of the side wall 336 across the notch 340. The fixed end portion of the pole strap 382 is further inserted through a portion of the pole ring 384 and sewn back to itself such that the pole ring 384 is at the juncture of the second or inner semi-cylindrical segment of the side wall 336 defining the notch 340 and the second flat segment of the side wall 336. The free end portion of the pole strap 382 may thus be extended across the notch 340 and through the pole ring 384 to secure the pole strap 382 across the notch 340.

The pole strap 382 may be simply tied to itself to hold the pole strap 382 in place across the notch 340. However, the fastening system 386 may be used to secure the pole strap 382 relative to the pole ring 384 when the pole strap 382 is extended through the pole ring 384. The example fastening system 386 comprises a first loop portion 390 secured to the free end portion of the pole strap 382, an optional second loop portion 392 secured to the first flat segment of the side wall 336, and a hook portion 394 secured to the free end portion of the pole strap 382. With the free end portion extended through the pole ring 384 as shown in FIGS. 16 and 17, the first loop portion 390 and the hook portion 394 face each other and can be detachably attached to prevent inadvertent movement of the pole strap 382 relative to the pole ring 384. If the optional second loop portion 392 is used, the hook portion 394 may be engaged with the second loop portion 392 to further prevent inadvertent movement of the pole strap 382 relative to the pole ring 384 and also to prevent the free end portion of the pole strap 382 from dangling from the weight container 330. Other fastening systems such as buckles, buttons, or the like may be used in addition or instead of the example hook and loop fastening system forming the example fastening system 386.

While a number of materials may be used to satisfy the functional requirements of the third example weight container 330, the materials described above with respect to the first example weight container 30 have been determined to provide a good balance of functionality and cost and may also be used to form like components of the third example container 330.

The material forming the example strap 382 is nylon webbing. The nylon webbing forming the example strap 382 is a 1.5" Y pattern nylon webbing of 32 grams per yard.

The third example weight system 320 may be used to support either of the first and second example umbrella systems 22 and 24 or possibly other upright items such as construction or traffic cones, light poles, portable pole mounted heaters, or the like.

To use the third example weight system 320 to support the first example umbrella system 32, the base assembly 120 is arranged at a desired location. The weight container 330 is then arranged such that the base stem 132 of the base structure 130 extends through the notch 340 in the weight container 330 and the lower wall 334 of the weight container 330 rests on the upper surface of the base structure 130. The pole strap 382 is then extended across the notch 340 over the stem 132, inserted through the pole ring 384, and secured in place using the fastening system 386. Inadvertent lateral movement of the base assembly 120 relative to the third example weight system 320 will thus be prevented by the securing system 380.

The weight container 330 is placed in its open configuration, and the desired amount of fill material 346 is arranged within the interior chamber 342 through the fill opening 344. The weight container 330 is then placed in its closed configuration. At this point, the weight of the weight container 330 and the fill material 346 contained by the weight container 330 will apply a downward force on the base structure 130.

The desired amount of fill material 346 will depend upon the nature of the fill material and the specifics of the first example umbrella system 22. The fill material 346 may be placed into the interior chamber 342 before arranging the notch 340 of the weight container 330 to receive the base stem 132, but may require lifting and moving of the entire third example weight system 320.

To use the third example weight system 320 to support the second example umbrella system 24, the base assembly 160 is arranged at a desired location. The weight container 330 is then arranged such that the base stem 172 of the base structure 170 extends through the notch 340 in the weight container 330 and the lower wall 334 of the weight container 330 rests on the upper surfaces of at least some of the legs 174, 176, 178*a*, and 178*b*. The pole strap 382 is then extended across the notch 340 over the stem 172, inserted through the pole ring 384, and secured in place using the fastening system 386. Inadvertent lateral movement of the base assembly 160 relative to the third example weight system 320 will thus be prevented by the securing system 380.

The weight container 330 is placed in its open configuration, and the desired amount of fill material 346 is arranged within the interior chamber 342 through the fill opening 344. The weight container 330 is then placed in its closed configuration. At this point, the weight of the weight container 330 and the fill material 346 contained by the weight container 330 will apply a downward force on the base structure 160.

The desired amount of fill material 346 will depend upon the nature of the fill material and the specifics of the second example umbrella system 24. The fill material 346 may be placed into the interior chamber 342 before arranging the notch 340 of the weight container 330 to receive the base stem 172, but may require lifting and moving of the entire third example weight system 320.

Although the example weight container 330 is substantially semicircular in top plan view and forms substantially semi-cylindrical shape with notch on the straight side thereof, other shapes may be used, several examples of which are described elsewhere in this application.

IV. Fourth Embodiment

Figure 19:
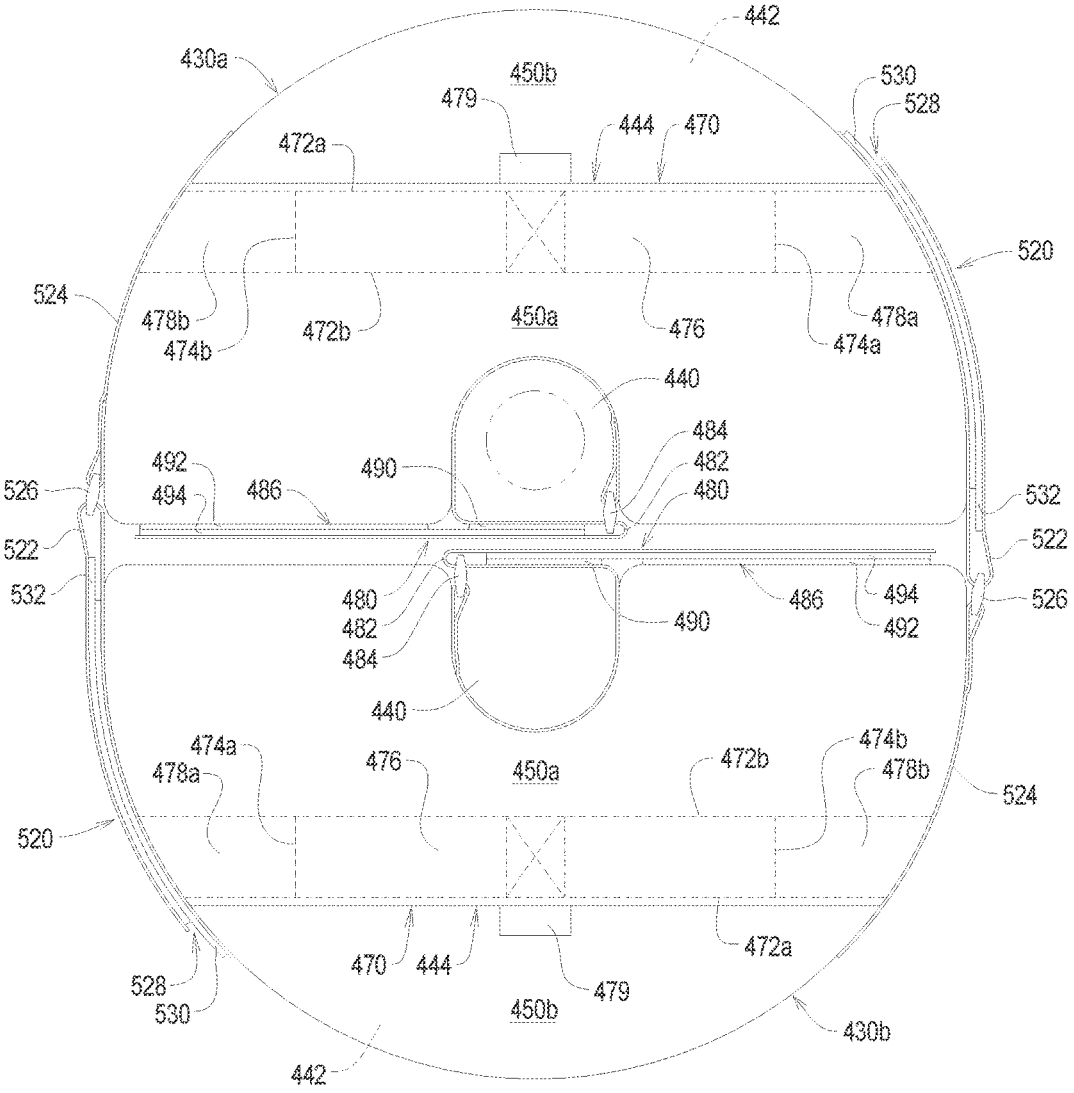
FIG. 19 is a top plan view of a fourth example weight system.
Figure 20:
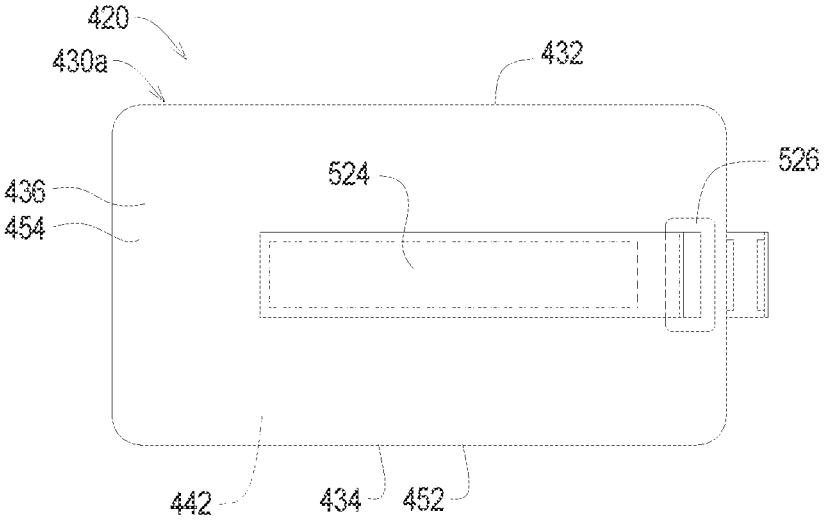
FIG. 20 is a first side elevation view of a first example weight container of the fourth example weight system.
Figure 21:
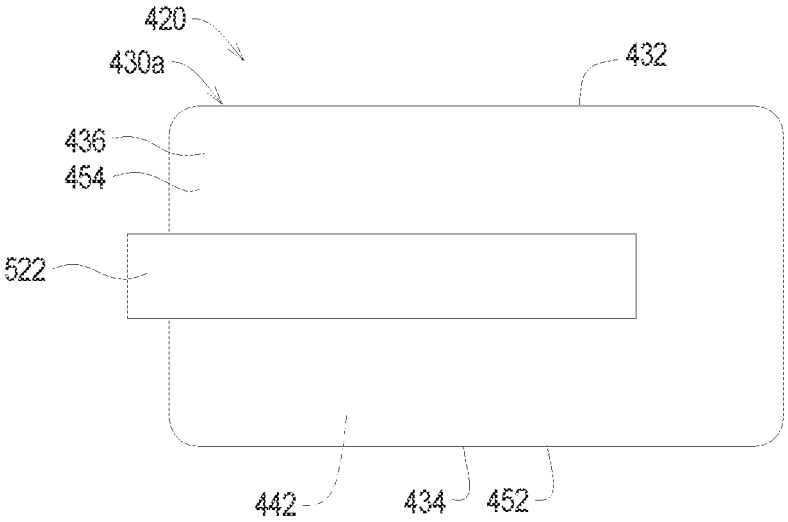
FIG. 21 is a second side elevation view of the first example weight container the fourth example weight system.

Referring now to FIGS. 19-21 of the drawing, depicted therein is a fourth example weight system 420 constructed in accordance with, and embodying, the principles of the present invention. The fourth example weight system 420 comprises a fourth and fifth weight containers 430*a* and 430*b*. The fourth and fifth example weight containers 430*a* and 430*b* are or may be identical. For clarity, the same reference characters will be used to identify common elements of the separate weight containers 430*a* and 430*b*.

Additionally, the example fourth and fifth weight containers 430*a* and 430*b* share many elements of the third example weight container 330 described above. The example fourth and fifth example weight containers 430*a* and 430*b* will thus be described herein primarily to the extent that they differ from the third example weight container 330.

The example weight containers 430*a* and 430*b* each define an upper wall 432, a lower wall 434, and a side wall 436. The example upper and lower walls 432 and 434 are flat and semi-circular but could be rectangular or other shapes. The example side wall 436 comprises a first semi-cylindrical segment, first and second flat segments, and a second semi-cylindrical segment. The diameter defined by the first semi-cylindrical segment is larger than that defined by the second semi-cylindrical segment. Each of the first and second flat segments extends between the first and second semi-cylindrical segments. The fourth and fifth example weight containers 430*a* and 430*b* each further defines a notch 440 and an interior chamber 442. A fill opening 444 is formed in each of the upper wall 432 through which fill material (not shown) is placed into the interior chamber 442.

The example weight containers 430*a* and 430*b* each comprises first and second upper panels 450*a* and 450*b* defining the upper wall 432, a lower panel 452 defining the lower wall 434, and a side panel 454 defining the side wall 436. The example panels 450*a*, 450*b*, 452, and 454 are made of a flexible fabric capable of containing the fill material (not shown) and bearing the weight fill material when the weight container 430 is filled with the fill material as described with reference to the other example weight containers described herein. The example first and second upper panels 450*a* and 450*b* are joined to the side panel 454 by an upper seam (not shown). The example lower panel 452 is joined to the side panel 454 by a lower seam (not shown). A vertical seam (not shown) joins ends of the side panel 454 to form the side wall 436. The example upper seam and lower seam may be constructed in the same manner as the example first upper seam 60 described above and will not be described herein in further detail.

A first outer edge of the example first upper panel 450*a* extends along a portion of a segmented path defined by the side wall 436. A first overlap edge of the example first upper panel 450*a* intersects the segmented path defined by the first upper panel 450*a* at first and second intersection points.

The example second upper panel 450*b* defines a second outer edge that also extends partly along the segmented path. A second overlap edge defined by the example second upper panel 450*b* intersects the segmented path at third and fourth intersection points. When the example weight container 430 is assembled, the third and fourth intersection points defined by the second overlap edge are arranged between a line extending between the first and second intersection points and the notch 440.

With the foregoing construction, the second overlap edge defined by the second upper panel 450*b* is arranged between the first overlap edge and the notch 440. Accordingly, the example first and second panels 450*a* and 450*b* overlap in an overlap region 470. The example overlap region intersects the segmented path at first and second intersection locations.

The example first and second upper panels 450*a* and 450*b* are sewn together by the first upper seam within the intersecting locations. The example first and second upper panels 450*a* and 450*b* are further sewn at least partly together by first and second chord stitches 472*a* and 472*b* and first and second end stitches 474*a* and 474*b*. The example first chord stitch 472*a* extends along a line extending between the first and second intersection points, while the example second chord stitch 472*b* extends along a line extending between the second and third intersection points. The example first and second chord stitches 472*a* and 472*b* are parallel to each other. The example end stitches 474*a* and 474*b* extend between the first and second chord stitches 472*a* and 472*b* at points that are approximately one fifth of the length of the chords defined by the first and second chord stitches 472*a* and 472*b* from the first and second intersection locations. The example end stitches 474*a* and 474*b* are parallel to each other.

The example chord stitches 472*a* and 472*b* and the example end stitches 474*a* and 474*b* divide the overlap region into a middle portion 476 and first and second end portions 478*a* and 478*b*. Outside of the middle portion 476, the chord stitches 472*a* and 472*b* join the first and second upper panels 450*a* and 450*b* together. Within the middle portion 476, the chord stitches 472*a* and 472*b* do not join the first and second upper panels 450*a* and 450*b* together but simply form seams to finish the edges of the first and second upper panels 472*a* and 472*b*. In particular, the example first chord stitch 472*a* forms a seam edge of the example first upper panel 450*a*, while the example second chord stitch 472*b* forms a seam edge of the example second upper panel 450*b*.

Accordingly, the first and second upper panels 450*a* and 450*b* are effectively sealed together in the first and second end portions 478*a* and 478*b*, but the fill opening 444 is defined between the first and second upper panels 450*a* and 450*b* within the middle portion 476.

A closure system (not visible) is arranged to detachably attach the first and second upper panels 450*a* and 450*b* within the middle portion 476 to close the fill opening 444. The example closure system is, like the example closure systems 80 and 280 described above, a hook and loop system, but other closure systems such as lacing, a zipper, or the like may be used in addition or instead. The example hook and loop system forming the closure system of the third example weight assembly 420 comprises a loop panel (not visible) secured to the first upper panel 450*a* within the middle portion 476 and a hook panel (not visible) secured to the second upper panel 450*b* within the middle portion 476. The loop panel overlaps the loop panel to effectively seal the first and second upper panels 450*a* and 450*b* together. More specifically, when the loop panel is attached to the hook panel, the weight container 430 is in a closed configuration in which access to the interior chamber 442 through the fill opening 444 is prevented. When the loop panel is detached from the hook panel, the weight container 430 is in an open configuration in which access to the interior chamber 442 is allowed through the fill opening 444. The fill material may be poured or otherwise passed through the fill opening 444 in the open configuration to allow the interior chamber 442 to be filled and/or emptied. A tab 479 may be secured to the first upper panel 450*a* to facilitate detachment of the hook panel from the loop panel and thus placement of the weight container 430 in the open configuration.

To fill the weight container 430, the hook panel is disengaged from the loop panel to place the weight container 430 in its open configuration. In this open configuration, the fill material is poured or otherwise passed through the fill opening 444 until a desired amount of fill material is within the interior chamber 442. During normal use of the fourth example weight container 430*a*, the hook panel engages the loop panel substantially to prevent the fill material from being displaced out of the interior chamber 442 through the fill opening 444. The weight container 430 may be arranged in a desired relationship to the item to be supported prior to introduction of the fill material into the interior chamber 442 to minimize carrying of the fully loaded weight container 430.

The example weight containers 430*a* and 430*b* each further comprises a securing system 480 comprising a pole strap 482, a pole ring 484, and a fastening system 486. As will be apparent from the following discussion, both securing systems 480 are not always required, but the use of a securing system 480 on each of the weight containers 430*a* and 430*b* provides simplicity in manufacturing and inventory control and provides flexibility for different uses in the field.

The pole strap 482 is secured to the side panel 454 such that the first pole strap 482 extends from the weight container 430 adjacent to the notch 440. In particular, a fixed end portion of the pole strap 482 is secured to the side panel 454 within the notch 440 such that a free end portion of the strap extends from the weight container 430 such that the free end portion strap can be extended from the first flat segment of the side wall 436 to the second flat segment of the side wall 436 across the notch 440. The fixed end portion of the pole strap 482 is further inserted through a portion of the pole ring 484 and sewn back to itself such that the pole ring 484 is at the juncture of the second or inner semi-cylindrical segment of the side wall 436 defining the notch 440 and the second flat segment of the side wall 436. The free end portion of the pole strap 482 may thus be extended across the notch 440 and through the pole ring 484 to secure the pole strap 482 across the notch 440.

The pole strap 482 may be simply tied to itself to hold the pole strap 482 in place across the notch 440. However, the fastening system 486 may be used to secure the pole strap 482 relative to the pole ring 484 when the pole strap 482 is extended through the pole ring 484. The example fastening system 486 comprises a first loop portion 490 secured to the free end portion of the pole strap 482, an optional second loop portion 492 secured to the first flat segment of the side wall 436, and a hook portion 494 secured to the free end portion of the pole strap 482. With the free end portion extended through the pole ring 484 as shown in FIG. 19, the first loop portion 490 and the hook portion 494 face each other and can be detachably attached to prevent inadvertent movement of the pole strap 482 relative to the pole ring 484. If the optional second loop portion 492 is used, the hook portion 494 may be engaged with the second loop portion 492 to further prevent inadvertent movement of the pole strap 482 relative to the pole ring 484 and also to prevent the free end portion of the pole strap 482 from dangling from the weight container 430. Other fastening systems such as buckles, buttons, or the like may be used in addition or instead of the example hook and loop fastening system forming the example fastening system 486.

In addition, each of the example fourth and fifth weight containers 430*a* and 430*b* comprises a container joining system 520 that allow the example fourth and fifth containers 430*a* and 430*b* to be joined together. The example container joining system 520 comprises a first joining strap 522, a second joining strap 524, a joining ring 526, and a strap joining system 528. A fixed end portion of the first joining strap 522 is sewn to the first semi-cylindrical segment of the first side wall 436 such that a free end portion of the first joining strap 522 extends from a juncture of the first semi-cylindrical segment of the first side wall 436 and the second flat segment of the first side wall 436. The second joining strap 524 is inserted through a portion of the joining ring 526, and both ends of the second strap 524 are sewn to the first semi-cylindrical segment of the first side wall 436. The joining ring 526 is located adjacent to a juncture of the first semi-cylindrical segment of the first side wall 436 and the first flat segment of the first side wall 436. The free end of the first joining strap 522 and the joining ring 526 are arranged on opposite sides of the notch 440.

The example strap joining system 528 may be used to secure the first joining strap 522 relative to an adjacent one of the joining ring 526 when the first joining strap 522 is extended through the adjacent one of the joining rings 526. The example fastening system 528 comprises a loop portion 530 secured to the fixed end portion of the first joining strap 522 and a hook portion 532 secured to the free end portion of the first joining strap 522. With the free end portion extended through one of the joining rings 526 as shown in FIG. 19, the loop portion 530 and the hook portion 532 face each other and can be detachably attached to prevent inadvertent movement of the first joining strap 522 relative to one of the joining rings 526. Other fastening systems such as buckles, buttons, or the like may be used in addition or instead of the example hook and loop fastening system forming the example strap joining system 528.

While a number of materials may be used to satisfy the functional requirements of the fourth example weight containers 430*a* and 430*b*, the materials described above with respect to the first example weight container 30 have been determined to provide a good balance of functionality and cost and may also be used to form like components of the fourth example weight containers 430*a* and 430*b*.

The material forming the example pole strap 482 and first and second joining straps 522 and 524 is nylon webbing. The nylon webbing forming the example straps 482, 522, and 524 is a 1.5" Y pattern nylon webbing of 32 grams per yard.

The fourth example weight system 420 may be used to support either of the first and second example umbrella systems 22 and 24 or possibly other upright items such as construction or traffic cones, light poles, portable pole mounted heaters, or the like.

To use the fourth example weight system 420 to support the first example umbrella system 22, the base assembly 120 is arranged at a desired location. The fourth and fifth example weight containers 430*a* and 430*b* are then arranged such that the base stem 132 of the base structure 130 extends through the notch 440 in either of the fourth and fifth weight containers 430*a* and 430*b* and the lower walls 434 of one or both of the fourth and fifth weight containers 430*a* and 430*b* rest on the upper surface of the base structure 130. The pole strap 482 is then extended across the notch 440 over the stem 132, inserted through the pole ring 484, and secured in place using the fastening system 486. At this point, the first joining strap 522 of the fourth example weight container 430*a* will be adjacent to the joining ring 526 of the fifth example weight container 430*b* and the first joining strap 522 of the fifth example weight container 430*a* will be adjacent to the joining ring 526 of the fourth example weight container 430*b*. The joining straps 522 are inserted through the adjacent joining rings 526 and secured in place using the strap joining system 528. Inadvertent lateral movement of the base assembly 120 relative to the fourth example weight system 420 will thus be prevented by the securing system 480.

The fourth and fifth weight containers 430*a* and 430*b* are placed in their open configurations, and the desired amount of fill material is arranged within the interior chambers 442 through the fill openings 444. The fourth and fifth example weight containers 430 are then placed in their closed configurations. At this point, the weight of the weight containers 430*a* and 430*b* and the fill material 446 contained by the weight containers 430*a* and 430*b* will apply a downward force on the base structure 130.

The desired amount of fill material will depend upon the nature of the fill material and the specifics of the first example umbrella system 42. The fill material may be placed into the interior chamber 442 before arranging the notch 440 of the weight container 430 to receive the base stem 132, but may require lifting and moving of the loaded fourth and fifth example weight containers 430*a* and 430*b*. Because the joining strap assemblies 520 may be disconnected to detach the fourth and fifth example weight containers 430*a* and 430*b* from each other, however, these fourth and fifth example weight containers 430*a* and 430*b* may be moved separately.

To use the fourth example weight system 420 to support the second example umbrella system 24, the base assembly 160 is arranged at a desired location. The fourth and fifth weight containers 430*a* and 430*b* are then arranged such that the base stem 172 of the base structure 170 extends through the notch 440 one of the weight containers 430*a* and 430*b* and the lower walls 434 of at least one, and typically both, of one or both of the fourth and fifth weight containers 430*a* and 430*b* rest on the upper surfaces of at least some of the legs 174, 176, 178*a*, and 178*b*. The pole strap 482 is then extended across the notch 440 over the stem 172, inserted through the pole ring 484, and secured in place using the fastening system 486. At this point, the first joining strap 522 of the fourth example weight container 430*a* will be adjacent to the joining ring 526 of the fifth example weight container 430*b* and the first joining strap 522 of the fifth example weight container 430*a* will be adjacent to the joining ring 526 of the fourth example weight container 430*b*. The joining straps 522 are inserted through the adjacent joining rings 526 and secured in place using the strap joining system 528. Inadvertent lateral movement of the base assembly 160 relative to the fourth example weight system 420 will thus be prevented by the securing system 480.

The fourth and fifth weight containers 430*a* and 430*b* are placed in their open configurations, and the desired amount of fill material is arranged within the interior chambers 442 through the fill openings 444. The fourth and fifth example weight containers 430 are then placed in their closed configurations. At this point, the weight of the weight containers 430*a* and 430*b* and the fill material 446 contained by the weight containers 430*a* and 430*b* will apply a downward force on the base structure 160.

The desired amount of fill material will depend upon the nature of the fill material and the specifics of the second example umbrella system 24. The fill material 446 may be placed into the interior chamber 442 before arranging the notch 440 of the weight container 430 to receive the base stem 172, but may require lifting and moving of the loaded fourth and fifth example weight containers 430*a* and 430*b*. Because the joining strap assemblies 520 may be disconnected to detach the fourth and fifth example weight containers 430*a* and 430*b* from each other, however, these fourth and fifth example weight containers 430*a* and 430*b* may be moved separately.

In addition to a side by side arrangement as depicted in FIG. 19, any of the example containers 30, 230, 330, or 430*a* and 430*b* may be stacked one on top of any of the other example containers 30, 230, 330, or 430*a* and 430*b*. In such a stacked configuration, only one of the weight containers may be in direct contact with the base member 130 or 160. The weight of the uppermost weight container of the stack is transferred to the base member 130 or 160 through the lowermost, and any intermediate, weight member of the stack. In this case, the joining straps such as the example joining straps 520 need not be used as shown in FIG. 19 to connect the example weight containers to each other. When stacked, the through holes 40 and 240 of the weight containers 30 and 230 receive the stem portion 132 or 162 to hold the weight containers 40 and/or 240 together. With weight containers 330, 430*a*, and 430*b* without a through hole, a securing system such as the securing systems 480 of the example weight containers 430*a* and 430*b* may be used to attach the respective weight containers 330, 430*a*, and 430*b* around the stem portion 132 or 172 as described above.

Although the example weight containers 430*a* and 430*b* are substantially semicircular in top plan view and each form a substantially semi-cylindrical shape with notch on the straight side thereof, other shapes may be used, several examples of which are described elsewhere in this application.

What is claimed is:

1. A weight system for containing fill material for supporting a free-standing object, comprising:

a container defining an interior chamber adapted to contain the fill material, where the container comprises an outer side wall made of an outer side panel of flexible fabric, a lower wall made of a lower panel of flexible fabric, an upper wall made of at least one upper panel of flexible fabric, where the upper wall is configured to define a fill opening, an inner side wall made of an inner side panel of flexible fabric, a first lower seam that joins the lower panel to the outer side panel, where the first lower seam is continuous around a lower outer edge of the lower wall, a second lower seam that joins the lower panel to the inner side panel, where the second lower seam is continuous around a lower inner edge of the lower wall, a first upper seam that joins the at least one upper wall panel to the outer side panel, where the upper seam is continuous around an upper outer edge of the upper wall, a second upper seam that joins the at least one upper wall panel to the inner side panel, where the upper seam is continuous around an upper inner edge of the upper wall; and a closure system comprising first and second portions, where the first closure portion is arranged to define a first side of the fill opening, and the second closure portion is arranged to define a second side of the fill opening;

wherein the closure system is arranged to allow the container to be configured in a closed configuration in which the first closure portion engages the second closure portion substantially to prevent access to the interior chamber through the fill opening, and an open configuration in which the first closure portion is disengaged from the second closure portion to allow access to the interior chamber through the fill opening; and the at least one upper panel may be displaced relative to the outer side wall to reconfigure the container between the open configuration and the closed configuration.

2. A weight system as recited in claim 1, in which:

one of the first and second closure portions is a hook panel; and one of the first and second closure portions is a loop panel that is detachably attachable the hook panel.

3. A weight system as recited in claim 1, in which:

the first closure portion is a first zipper portion; and the second closure portion is a second zipper portion that is detachably attachable to the first zipper portion.

4. A weight system as recited in claim 1, in which the closure system further comprises laces that detachably attach the first closure portion to the second closure portion.

5. A weight system as recited in claim 1, in which the upper wall comprises first and second upper wall panels, where the first closure portion is connected to the first upper wall panel and the second closure portion is connected to the second upper wall panel.

6. A weight system as recited in claim 5, in which the first and second upper wall panels overlap to define an overlap region, where the first and second closure portions are arranged within the overlap region.

7. A weight system as recited in claim 6, in which:

at least a portion of the overlap region intersects the first upper seam.

8. A weight system as recited in claim 1, further comprising a joining system configured to allow at least a portion of the container to be secured relative to the free-standing object.

9. A weight system as recited in claim 1, further comprising fill material, in which:

with the container in the open configuration, the fill material is arranged within the interior chamber through the fill opening; and with the fill material within the interior chamber and the container in the closed configuration, the container may be arranged to apply a force to at least a portion of the free-standing object.

10. A weight system as recited in claim 1, in which:

the lower inner edge and the lower outer edge of the lower wall are curved to define a first closed shape;

the upper inner edge and the upper outer edge of the upper wall are curved to define a second closed shape.

11. A weight system as recited in claim 10, in which the first and second closed shapes are substantially circular.

12. A weight system as recited in claim 1, in which the fill opening and the closure system are arranged above the fill material within the interior chamber of the container.

* * * * *